US007155952B2

(12) United States Patent
Rachi et al.

(10) Patent No.: US 7,155,952 B2
(45) Date of Patent: Jan. 2, 2007

(54) DEVICE AND METHOD FOR FORMING PIPING COMPONENTS

(75) Inventors: Mamoru Rachi, Shizuoka-ken (JP); Yoji Tashiro, Shizuoka-ken (JP); Tamio Yoshino, Shizuoka-ken (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 11/233,534

(22) Filed: Sep. 22, 2005

(65) Prior Publication Data

US 2006/0059972 A1 Mar. 23, 2006

Related U.S. Application Data

(63) Continuation of application No. PCT/JP04/03830, filed on Mar. 22, 2004.

(30) Foreign Application Priority Data

Mar. 24, 2003 (JP) ..... 2003-081614
Mar. 24, 2003 (JP) ..... 2003-081633
Mar. 24, 2003 (JP) ..... 2003-081639

(51) Int. Cl.
*B21D 9/15* (2006.01)

(52) U.S. Cl. ..... 72/369; 72/370.22

(58) Field of Classification Search ..... 72/369, 72/57, 60, 370.22, 149, 150
See application file for complete search history.

(56) References Cited

U.S. PATENT DOCUMENTS 3,105,537 A * 10/1963 Foster ..... 72/57
3,739,615 A * 6/1973 Tressel ..... 72/57
2004/0007037 A1* 1/2004 Yoshino et al. ..... 72/369

FOREIGN PATENT DOCUMENTS

JP 10-58051 * 3/1998
JP 2002-192237 7/2002
JP 2002-254112 9/2002

OTHER PUBLICATIONS

International Search Report; Dated Oct. 12, 2004; International Appl. No. PCT/JP2004/003830; 25 pages.

* cited by examiner

*Primary Examiner*—Derris H. Banks
*Assistant Examiner*—Debra Wolfe
(74) *Attorney, Agent, or Firm*—Knobbe, Martens, Olson & Bear, LLP

(57) ABSTRACT

A method and apparatus for being hollow work pieces has a pressurizing arrangement that allows the pressure to be adjusted in an internal cavity defined within the work pieces between subsequent bending operations on any one work piece. The internal cavity is defined by sealing caps that are secured to the ends of the work piece.

20 Claims, 24 Drawing Sheets

| Operator | Bending equipment | | | | | | | | Hydraulic pressure alteration | |
|---|---|---|---|---|---|---|---|---|---|---|
| | Chucking section 51 | Moving section 53 | Chucking carriage 50 | Chucking carriage 50 | Twisting | Clamping section 42 | Pressing section 43 | Bending section 41 | Mechanical section | Water pressurizing section |
| Attaches next pipe | | | | | | | | | Pressurizing coupler coupled | Test water pressure provided |
| Detaches bending-finished pipe | | | | | | | | Bending arm returned | Pipe positioning components returned | Test water pressure confirmed |
| Pushes chucking button | Chuck loosened | | | | Twisting | | | | | Pressurized to first bending water pressure (Warning made under improper condition) |
| Pushes start button | | | | | | Tightened | Tightened | First bending started | | |
| | | Moved back | | | | | | First bending finished | | |
| | | | Carriage returned | | | Loosened | Loosened | | | First bending water pressure confirmed (Warning made under improper condition) |
| | | | Carriage moved out | | Twisting | | | Bending arm returned | | |
| | | Moved forward | | | | Tightened | Tightened | Second bending started | | Pressure changed to second bending water pressure |
| | | | Carriage returned | | | Loosened | Loosened | Second bending finished | | |
| | | | Carriage moved out | | | | | | | Second bending water pressure confirmed |
| | | Moved forward | | Carriage lowered | | | | Bending arm returned | | |
| | | | Carriage returned | | Twisting | | | | | Pressure changed to third bending water pressure |
| | | | | | | Tightened | Tightened | | | |
| | Chuck loosened | | | | | | | Third bending started | Ring of pressurizing coupler removed | Third bending water pressure confirmed |
| | | Moved back (Pipe setting position) | | | | Loosened | | Third bending finished | Pipe positioning components moved | Pressure released |
| | | | Carriage moved out | | | | Loosened | | | |
| | | | | Carriage raised | | | | | Ring of pressurizing coupler returned | |
| | | | | | | | | | Pressurizing coupler returned | |

*Figure 23*

DEVICE AND METHOD FOR FORMING PIPING COMPONENTS

CROSS-REFERENCE TO RELATED APPLICATIONS

This application is a continuation of PCT Application No. PCT/JP2004/003830, filed Mar. 22, 2004, which is based upon Japanese Patent Application No. 2003-81614, filed Mar. 24, 2003, Japanese Patent Application No. 2003-81633, filed Mar. 24, 2003, and Japanese Patent Application No. 2003-81639, filed Mar. 24, 2003, each of which is hereby incorporated by reference in its entirety.

BACKGROUND OF THE INVENTION

1. Field of the Invention

The present invention generally relates to a method for bending a work piece that is used to convey a liquid, a gas or a solid, including a powder, or a combination thereof, and a device for bending the pipe. More particularly, the present invention relates to an exhaust pipe connecting together an engine and a muffler of a motorcycle, a snowmobile, a four wheeled buggy, and the like.

2. Description of the Related Art

Conventionally, a curved section of a conveyance pipe can be formed with a stainless steel pipe that has been bent to be a certain configuration. This kind of pipe preferably has a fixed inner diameter so that a fluid can flow smoothly through its inner cavity, or, in the case of an exhaust pipe, a pressure wave is not unnecessarily reflected midway. However, when a pipe is bent, the inside surface of the pipe is uneven because the outer radius of curvature is larger than the inner radius of curvature. The conventional pipe thus has a drawback that a curved portion thereof can be partially flat at a bent portion, which naarows the inner cross sectional area.

Such a drawback can be corrected to a certain extent if the pipe is bent while a liquid is enclosed within the inner cavity of the bent portion and the pipe is tightly closed (for example, JP-A-2002-254112 (Pages 1 through 12 and FIGS. 1 through 14)).

However, in this bending device, for bending a plurality of portions of a single work piece, when a setup change is made from one bending process to a subsequent bending process, a three way valve is switched so that water can be returned to a water tank from a high pressure pump, and a water pressure in the work piece is decreased to zero during every setup change. Thus, the number of steps involved increases which ultimately decreases efficiency.

Also, in the bending device, a bent work piece is wound around a roll mold. Processes are provided for removing the completed work piece from the roll mold and temporarily placing the completed work piece to one side while the next work piece is carried to the roll mold. Processes also are provided for carrying the bent work piece or a subsequent work piece, which will have been temporarily placed to one side. In addition, processes are provided for removing the completed work piece from the roll mold and carrying the completed work piece away and then subsequently placing a temporarily placed work piece on the bending device for completion.

Therefore, problems are caused. For example, a long time is necessary to remove the bending-finished work piece that is wound around the roll mold and to mountthe bending-finished work piece that is going to be bent next. Also, space must be provided in which a work piece can be temporarily set aside. Thus, the size of the device must be increased.

An object of a first invention is to provide a method for bending a work piece and a device for bending the work piece both of which can reduce the number of steps involved and can improve the working efficiency.

Also, an object of second and third inventions is to provide a method for bending a work piece and a device for bending the work piece both of which can save time for removing a bending-finished work piece and for setting another material that is going to be bent to improve the productivity, and can contribute to making the device compact.

SUMMARY OF THE INVENTION

Accordingly, in one aspect of the present invention a method for bending a work piece 30 is provided in which a plurality of middle portions of a single work piece 30 are bent when both ends of the work piece are tightly closed by respective caps and an internal cavity of the work piece is filled with a liquid. An internal pressure of the work piece is adjustable through the caps. The internal pressure of the work piece can therefore be adjusted to match the radius of curvature and angle of curvature sought in each bend. Thus, the internal pressure of the work piece 30 can be adjusted in such a manner that one pressure suitable for one bending is changed to another pressure suitable for a next bending. Advantageously, the pressure changes after the one bending ends and before the next bending process starts.

Another aspect of the present invention involves supporting one end of the work piece with a chucking section of a chucking carriage that can move toward or back from a bending machine side while another end of the work piece is mounted on a supporting section of the bending machine side and a position of the work piece that is set is deflected from a bending section of the bending machine. Further, the one end of the work piece is cantilevered by the chucking section that is positioned at a platform and is movable toward and back from the bending machine. In addition, a pressurizing coupler is connected to a cap of the end to make an internal pressure of the work piece changeable. At least one of the bending machine and the chucking section is moveable relative to the platform to move the work piece to a bending position of the bending section from a setting position at which the work piece is set to be cantilevered by the chucking section relative to the bending machine. Another end of the work piece is bent by the bending machine while another end is supported. After bending in a state that the internal pressure of the work piece is adjusted, the cantilevering support by the chucking section is released, the pressurizing coupler is detached, and the chucking section is moved to the setting portion relative to the bending machine.

A further aspect of the present invention involves a method of making multiple bends to a work piece, wherein the work piece is generally tubular in configuration, the work piece comprises a first end and a second end, a first end cap substantially closes the first end and a second end cap substantially closes the second end, with an internal cavity being defined within the work piece between the first end cap and the second end cap. The method comprises introducing a fluid into said internal cavity through one of said first and second end caps, pressurizing the fluid to a first pressure within said internal cavity, conducting a first bending operation, after conducting the first bending operation but before conducting a second bending operation, adjusting the fluid to a second pressure within said internal cavity, said second pressure corresponding to a desired pressure for conducting the second bending operation and after conducting the second bending operation but before conducting a third bending operation, adjusting the fluid to a third pressure within said internal cavity, said third pressure corresponding to a desired pressure for conducting the third bending operation.

An aspect of the present invention also involves a device for bending a work piece, wherein the work piece is generally tubular in configuration, the work piece comprises a first end and a second end, a first end cap substantially closes the first end and a second end cap substantially closes the second end, with an internal cavity being defined within the work piece between the first end cap and the second end cap. The device comprises a bending device and a chucking carriage. The chucking carriage is moveable relative to the bending device. A pressurizing coupler is axially moveable relative to the chucking carriage. The pressurizing coupler is configured to removably connect with the first end cap. The pressurizing coupler comprises a fluid passage that is in communication with the internal cavity of the work piece when the pressurizing coupler is connected with the first end cap. Pressure adjusting means is provided for altering a pressure in the internal cavity of the work piece to a bend specific pressure prior to a second bending operation and subsequent to a first bending operation.

BRIEF DESCRIPTION OF THE DRAWINGS

These and other features, aspects and advantages of the present invention will now be described with reference to the drawings of a preferred embodiment, which embodiment is intended to illustrate and not to limit the invention, and in which figures:

FIG. 23 is an illustration for describing the bending operation.

DETAILED DESCRIPTION OF THE PREFERRED EMBODIMENT

Figure 1:
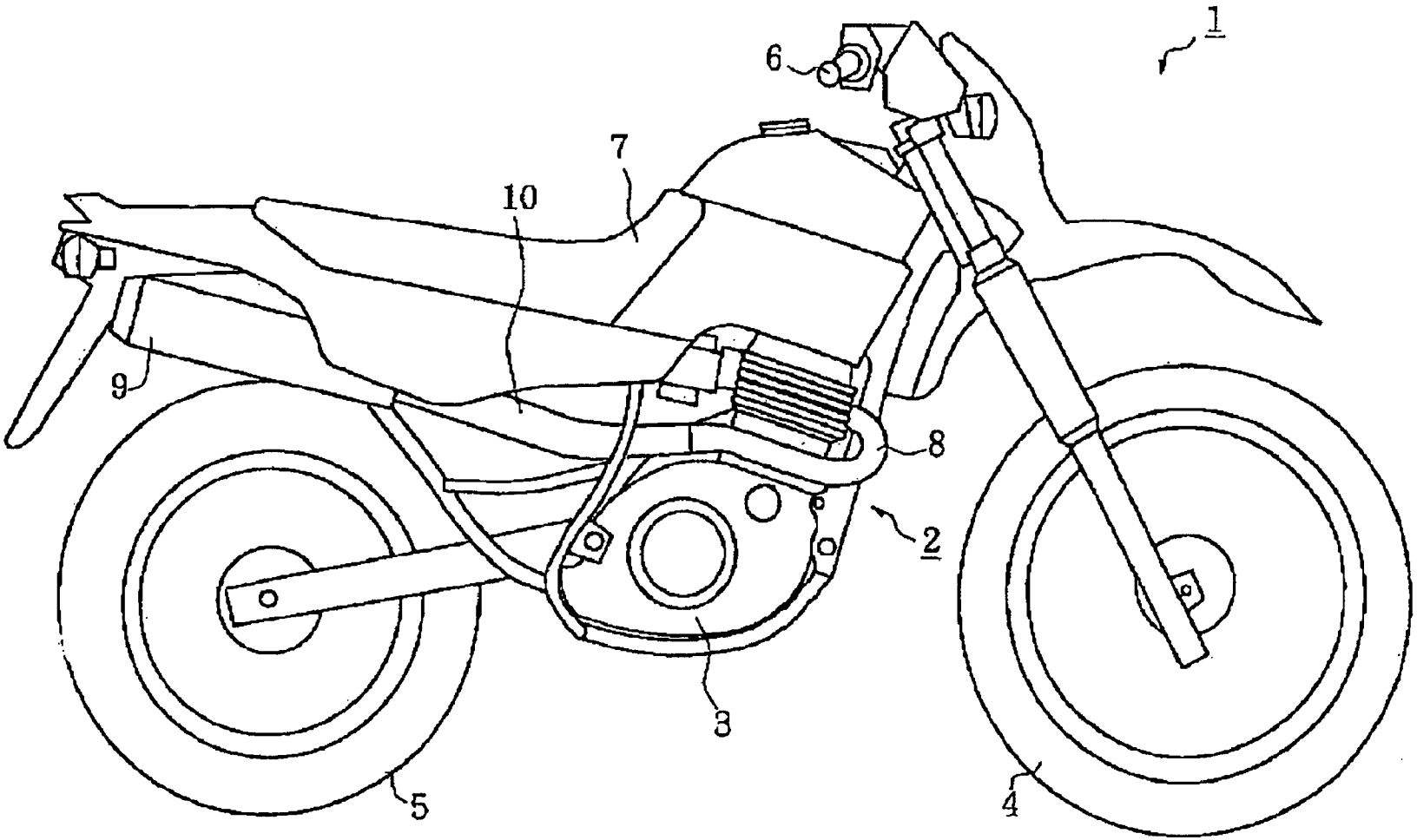
FIG. 1 is a side elevation view of a motorcycle having an exhaust pipe produced by a device and method for bending pipe, which device and method are arranged and configured in accordance with certain features, aspects and advantages of the present invention.

With reference initially to FIG. 1, a motorcycle 1 has an exhaust pipe 8. The exhaust pipe 8 preferably is produced by a method for bending a work piece and by a device for bending the work piece that are arranged and configured in accordance with certain features, aspects and advantages of the present invention.

In a preferred configuration, the motorcycle can have a four cycle, single cylinder engine 3 that is mounted on a vehicle body frame 2. The motorcycle 1 also comprises a front wheel 4, a rear wheel 5, steering handle bars 6 and a seat 7. The exhaust pipe 8 can be connected to the engine 3. A rear exhaust pipe, which comprises a muffler 9 that is disposed at its rear end, is connected to a downstream end of the exhaust pipe 8 in one particular configuration.

Figure 2:
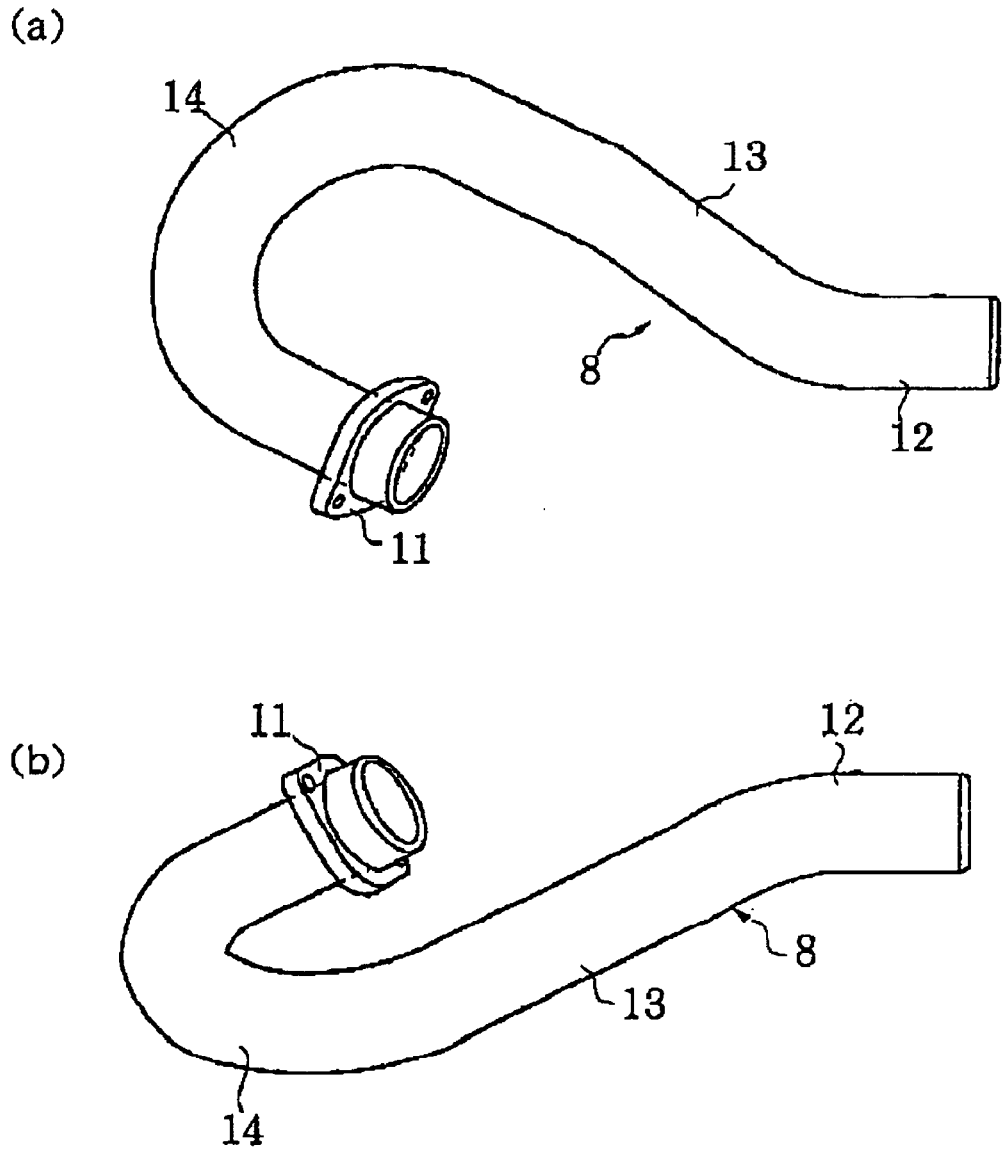
FIGS. 2(*a*) and 2(*b*) are perspective illustrations of the exhaust pipe of FIG. 1 and are a top plan view and a right side elevation view, respectively.

With reference now to FIG. 2, the exhaust pipe 8 shown therein can be produced by a method for bending a work piece and by a device for bending the work piece that are arranged and configured in accordance with certain features, aspects and advantages of the present invention. FIG. 2(*a*) is a top plan view and FIG. 2(*b*) is a right side elevation view of the exhaust pipe 8. A flange 11 can be welded to one end (e.g., the upstream end) of the exhaust pipe 8 and the flange 11 can be used to connect the exhaust pipe 8 to the engine. The exhaust pipe preferably is formed into the illustrated shape, which comprises three bent portions. The three bent portions formed on the illustrated exhaust pipe 8 are indicated by the reference numerals 12 through 14. In other words, the exhaust pipe under goes at least three bending operations during manufacturing.

Figure 3:
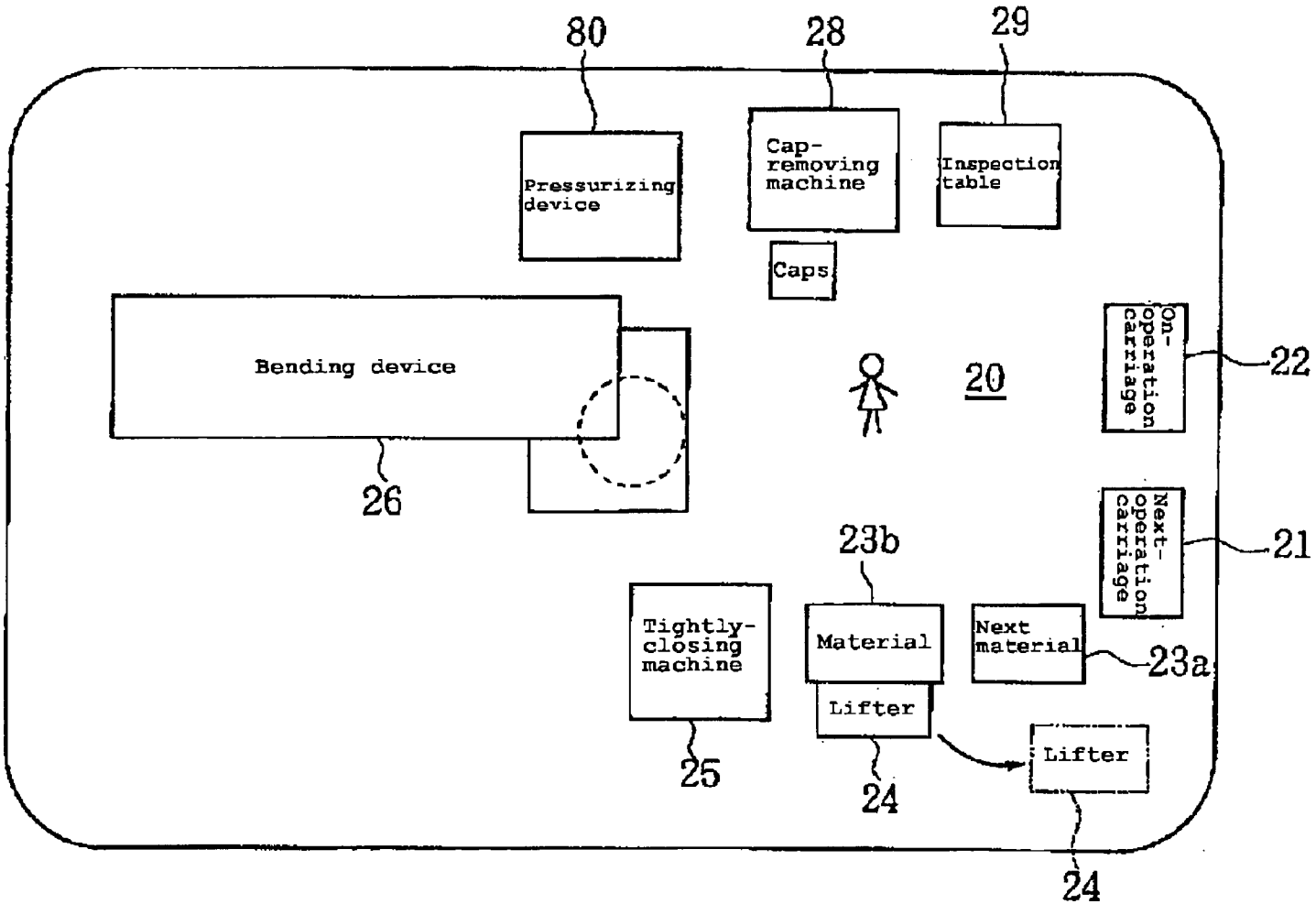
FIG. 3 is a schematic top plan view of a production line layout featuring a bending device that is arranged and configured in accordance with certain features, aspects and advantages of the present invention.

With reference now to FIG. 3, a production line 20 is shown that can be used for accomplishing certain features, aspects and advantages of the present invention. In the layout of the illustrated production line, a next-operation carriage 21, an on-operation carriage 22, a first pallet 23*a*, a second pallet 23*b*, a lifter 24, a sealing machine 25, a bending device 26, a pressurizing device 80, a cap-removing machine 28 and an inspection table 29 are provided. These components can be organized in the manner shown in FIG. 3 or these components can be organized in any suitable manner. In one configuration, these components can be disposed around a working area 20 where an operator is stationed.

A predetermined number of work pieces that are going to be bent are placed on the first pallet 23*a*, while one or more additional work pieces can be placed on the second pallet 23*b*. In one configuration, the lifter 24 can be a hand lift for carrying the pallets 23*a*, 23*b*. In another configuration, the lifter 24 can be a mechanized device. In the preferred configuration, the lifter 24 is inserted into a space below any one of the pallets 23*a*, 23*b* to lift it up. After lifting, the lifter 24 can be used to move the pallet to a desired position before lowering the pallet for loading, for example. Thus, the lifter 24 can be used to sequentially move the work pieces to or from the sealing machine 25.

The sealing machine 25 closes both ends of each work piece with end caps 31, 32 and fills an internal cavity of the work piece with a liquid. Preferably, the end caps 31, 32 are mounted to the work piece ends such that the end caps 31, 32 tightly close the ends of the work piece. In a preferred configuration, the end caps 31, 32 are sealed to the ends of the work piece in a fluid tight configuration.

The bending device 26 is used to bend each work piece in such a manner that the middle regions of the work piece are suitably deformed.

The pressurizing device 80 is used to adjust the pressure of fluid contained within each work piece.

The cap-removing machine 28 removes the end caps 31, 32 from a work piece when it has been suitably formed.

The formed product is then inspected on the inspection table 29 to confirm that the formed product meets any desired quality control measurements.

The respective formed products which have been inspected can then be sequentially loaded on the on-operation carriage 22. When a certain number of the formed products are loaded on the on-operation carriage 22, the on-operation carriage 22 can be moved out of the illustrated production line. For instance, the formed products can be moved into storage. Because of the movement of the on-operation carriage 22, the next-operation carriage 21 can be moved to the position at which other inspected formed products are loaded. In other words, the next-operation carriage 21 can be considered an empty carriage onto which formed products can be loaded while the on-operation carriage 22 is being unloaded. The inspected formed products, therefore, can be sequentially loaded onto the next-operation carriage 21.

Figure 4:
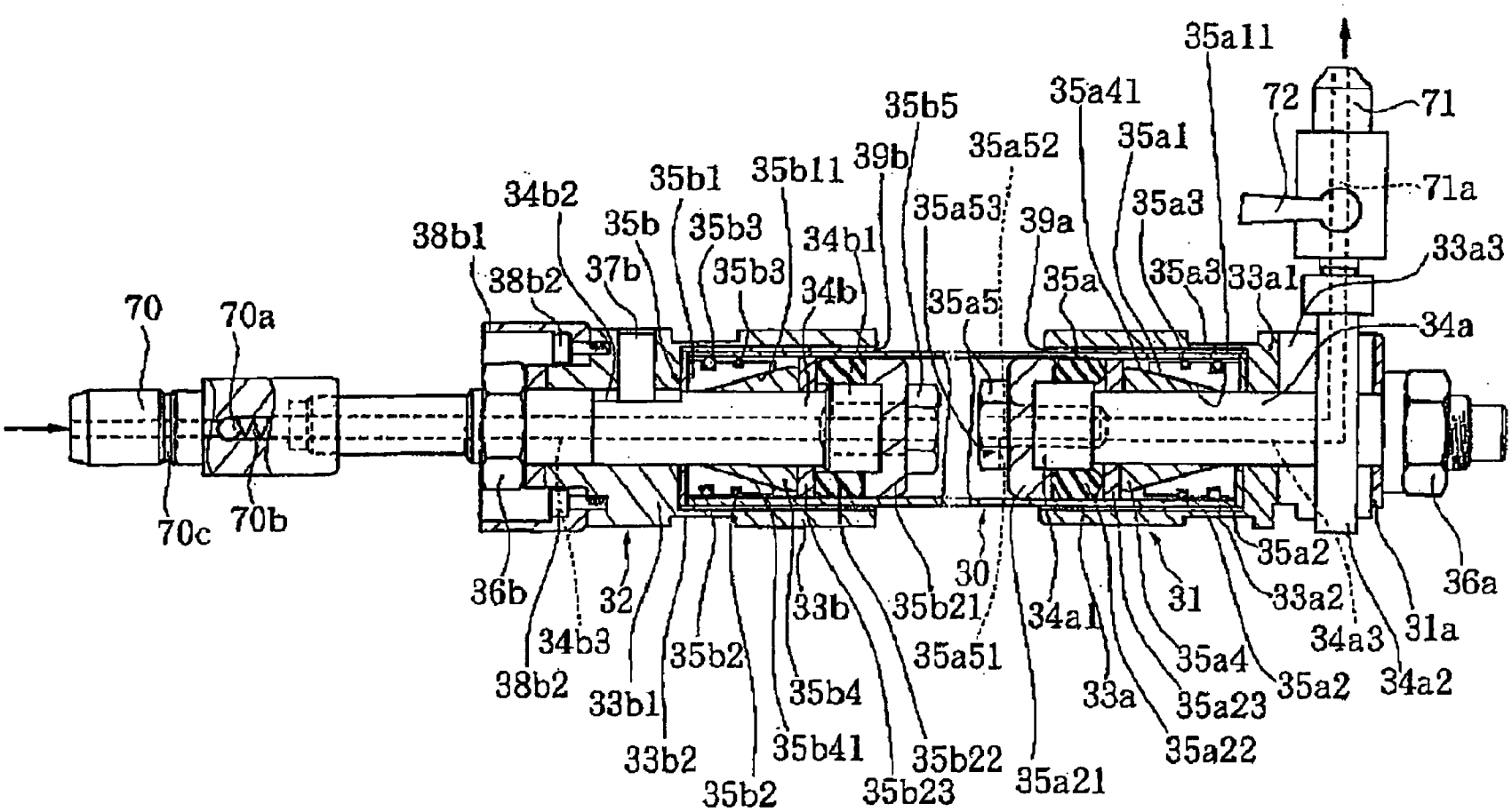
FIG. 4 is a cross sectional view of a cap, which has been attached to a work piece, such as the exhaust pipe.

With reference now to FIG. 4, a substantially closed internal cavity is defined within the work piece 30 using end caps 31, 32. This cavity can be filled with fluid. In one configuration, the end caps 31, 32 are applied to the work piece 30 and the work piece is filled with fluid in the sealing machine 25. In other configurations, the fluid can be added by a separate machine; however, the illustrated configuration advantageously reduces the number of machines and the number of steps associated with the bending process.

As shown in FIG. 4, the end caps 31, 32 are attached to the ends of the work piece 30. In the illustrated arrangement, the end cap 31 is not connected to anything during the bending process and the end cap 32 is connected to the pressurizing device 80 during the bending process. Other suitable configurations also can be used. In the illustrated arrangement, the work piece 30 is a generally straight pipe and is used to form the exhaust pipe 8.

The end caps 31, 32 preferably tightly close the internal cavity of the work piece 30. The respective end caps 31, 32 can be coupled with the sealing machine 25 to fill the internal cavity of the work piece 30 with water or any other suitable fluid, liquid or gaseous. Preferably, the fluid is generally not compressible or is only slightly compressible. After filling, couplings (described below) with the end caps 31, 32 can be released and the water then will be substantially maintained within the internal cavity of the work piece 30 at a predetermined pressure.

In some configurations, the work piece 30 is formed into an elongated tubular structure by bending a flat material, such as a plate or sheet of metal, around a bending plane. In such a configuration, the flat material is bent around a central axis of the work piece. The edges of the work piece that are brought together than can be secured together in any suitable manner (e.g., butt welded and the like). To reduce the likelihood that the welding beads will damage the final work piece 30 and to reduce the likelihood that the welding beads will result in an imperfection in the final work piece 30, the angular orientation of an opening and closing valve 72, which will be described below, is controlled relative to the welding beads when the end caps 31, 32 are mounted to the work piece 30. In other words, the end caps are oriented such that during bending, a plane extending through the centerline of the work piece and a center of curvature is offset from the welding bead.

With continued reference to FIG. 4, the end caps 31, 32 each has a generally cylindrical outer member 33*a*, 33*b* that slides over the respective end of the work piece 30. The outer members 33*a*, 33*b* preferably have the configuration of a cylinder that is closed at one end although other configurations also are possible. In one configuration, the outer members 33*a*, 33*b* are formed from aluminum or any other suitable material. The end caps 31, 32 each also has a locking member 35*a*, 35*b* fastened to the respective outer member 33*a*, 33*b* by a supporting bolt 34*a*, 34*b*. A reinforcing sleeve 39*a*, 39*b* can be press-fit into or otherwise suitably mounted inside of or outside of the outer member 33*a*, 33*b*. The reinforcing sleeve 39*a*, 39*b* can be formed of any suitable material, such as, for instance but without limitation, steel or the like.

Each of the illustrated locking members 35*a*, 35*b* comprises a plurality of claws 35*a*1, 35*b*1 arranged generally circumferentially and a circular coil spring 35*a*3, 35*b*3 that is positioned within one or more ring grooves 35*a*2, 35*b*2 formed on an outer circumferential surface of each claw 35*a*1, 35*b*1. In some configurations, snap rings, o-rings, circlips and the like can be positioned in the grooves 35*a*2, 35*b*2. Other configurations also are possible. The springs 35*a*3, 35*b*3 or the like help to return the claws 35*a*1, 35*b*1 to an original position following expansion, which will be described directly below.

The outer circumferential surface of each claw 35*a*1, 35*b*1 can be moved radially outward to be pressed onto an inner circumferential surface of the end portion of the respective work piece 30. In some configurations, the claw 35*a*1, 35*b*1 can be defined by a generally cylindrical member with a single slit and a conical center passage such that only one claw is defined rather than a plurality of claws being defined. In the illustrated configuration, four slits define four claws 35*a*1, 35*b*1 but other numbers also can be used.

Each claw 35*a*1, 35*b*1 is positioned between an end of the respective outer member 33*a*, 33*b* and a combination of a nut 36*a*, 36*b* and a wedge 35*a*4, 35*b*4. Thus, as the surface area in contact between the wedge 35*a*4, 35*b*4 and the claw 35*a*1, 35*b*1 increases, the claw 35*a*1, 35*b*1 expands outward into more firm contact with the work piece 30, thereby sandwiching the work piece 30 between the claw 35*a*1, 35*b*1 and the outer member 33*a*, 33*b*.

A supporting member 35*a*21, 35*b*21 (e.g., a washer-type member) can be positioned over an inner end of a supporting bolt 34*a*, 34*b* and secured thereto by a respective bolt 35*a*5, 35*b*5. A suitable seal 35*a*22, 35*b*22, which can be formed of rubber or another suitable resilient material, can abut the supporting member 35*a*21, 35*b*21. The seal 35*a*22, 35*b*22 preferably is positioned over an enlarged step portion 34*a*1, 34*b*1 of the inner end of the supporting bolt 34*a*, 34*b*. Moreover, the seal 35*a*22, 35*b*22 preferably is positioned between the supporting member 35*a*21, 35*b*21 and a plate member 35*a*23, 35*b*23.

The plate member 35*a*23, 35*b*23 preferably abuts the wedge 35*a*4, 35*b*4. As described above, the tapered surface 35*a*41, 35*b*41 of each wedge 35*a*4, 35*b*4 presses a tapered surface 35*a*11, 35*b*11 of the respective claw 35*a*1, 35*b*1 so that each wedge 35*a*4, 35*b*4 expands in the radial direction to tightly contact on the inner circumferential surface of the work piece 30. Thus, the caps 31, 32 can be securely mounted to the work piece 30.

Each supporting bolt 34*a*, 34*b* is arranged to be tightened with the respective nut 36*a*, 36*b*, which is screwed onto an outer end of the bolt 34*a*, 34*b* so that the supporting member 35*a*21, 35*b*21 and the plate 35*a*23, 35*b*23 can together squeeze the respective seal 35*a*22, 35*b*22. That is, by tightening the nut 36*a*, 36*b*, each seal 35*a*22, 35*b*22 is compressed in its axial direction which advantageously expends it in the radial direction. Thus, an outer circumferential surface of each seal 35*a*22, 35*b*22 can be pressed into engagement with the inner surface of the work piece 30. In one advantageous configuration, the seal 35*a*22, 35*b*22 forms a substantially or completely water tight seal with the inner surface of work piece 30.

In the illustrated embodiment, each supporting bolt 34*a*, 34*b* advantageously has a step section 34*a*1, 34*b*1 defined by a larger diameter portion. If the nut 36*a*, 36*b* is excessively tightened, the step section 34*a*1, 34*b*1 will abut on the plate 35*a*23, 35*b*23. Thus, the extent to which each seal 35*a*22, 35*b*22 can be compressed in its axial direction is regulated, which reduces the likelihood of the seal 35*a*22, 35*b*22 being excessively expanded in the radial direction or compressed in the axial direction.

A supporting member, which is not shown, of the sealing machine 25 preferably engages a flat 33*a*2, 33*b*2 that is formed on each of the outer members 33*a*, 33*b*. In other words, the generally cylindrical outer members 33*a*, 33*b* are preferably provided with a flat 33*a*2, 33*b*2 that can be used by the sealing machine 25 to support the outer member 33*a*, 33*b* in the axial direction and in the circumferential direction. Thus, the flat 33*a*2, 33*b*2 defines an orienting structure. Any other suitable orienting structure also can be used.

In the illustrated end cap 32, a spin-stop key 37*b* is inserted into the illustrated outer member 33*b* in the radial direction. The key 37*b* preferably is positioned within a key slot 34*b*2 formed in the supporting bolt 34*b*. The key 37*b* can reduce the likelihood of the end cap 32 rotating relative to the supporting bolt 34*b* when the nut 36*b* is tightened on the outer end of the supporting bolt 34*b*. Other configurations also can be used.

Also, a coupling member 38*b*1 can be secured to a chucking section side of the outer member 33*b*. In the illustrated arrangement, the coupling member 38*b*1 is secured to the outer member 33*b* with threaded fasteners 38*b*2, but any suitable manner of joining the coupling member 38*b*1 to the outer member 33*b*1 or to another component of the end cap 32 can be used.

In the illustrated end cap 32, an aperture 34*b*3 is formed through the supporting bolt 34*b*. In one configuration, the aperture 34*b*3 is formed at an axial center of the supporting bolt 34*b*. In one preferred configuration, the aperture 34*b*3 is formed by drilling but any suitable technique can be used. The aperture 34*b*3 communicates with an aperture of the other bolt 35*b*5. In some configurations, the aperture of the bolt 35*b*5 is positioned in the center of the bolt 35*b*5. Thus, an internal cavity of the work piece 30 can communicate with an external location through the end cap 32. In other words, the internal cavity of the work piece is fluidly connected to a passage formed through the end cap 32. A pressure receiving coupler 70 can be attached to the outer end of the supporting bolt 34*b* such that the pressure receiving coupler is in fluid communication with the internal cavity of the work piece 30.

The pressure receiving coupler 70 can comprise a check valve 70*a* that is defined by an internal passage in which a ball is positioned. The ball is biased by a spring 70*b* such that the ball restricts flow to a first direction and the flow in the first direction can only occur if sufficient pressure moves the ball from a seat defined in the internal passage by overcoming the biasing force of the spring 70*b*. In some arrangements, however, the check valve 70*a* can be opened by a mechanical interaction. For instance, a pressurizing coupler 52 can be provided with a push rod, which is not shown, that extends into the passage and pushes the ball of the check valve 70*a* such that flow can occur in both directions when the ball is unseated by the push rod. In other words, when the associated pressurizing coupler 52 is attached, the check valve 70*a* is opened by the push rod.

In the illustrated embodiment, the coupler 70 can be provided with a quick-disconnect style of coupling. For instance, in the illustrated configuration, a groove 70*c* extends around the outer circumference of the coupler 70. The groove 70*c* engages with a suitable structure to maintain a connection between the coupler 70 and the pressurizing coupler 52. Such a structure will be described in greater detail below.

In the illustrated end cap 31, a cross member 34*a*2 extends through the supporting bolt 34*a* and provides the bolt with a generally cross shaped configuration. The cross member 34*a*2 and the bolt 34*a* can be formed of separate components that are mounted together or the two elements can be integrally formed from a single piece of material. The cross member 34*a*2 preferably engages with a groove 33*a*3 having a generally u-shaped cross-sectional configuration formed at a bottom portion 33*a*1 of the outer member 33*a*. Thus, the nut 36*a* that is screwed onto the outer end of a generally vertical portion of the supporting bolt 34*a* is generally prevented from rotating relative to the supporting bolt 34*a* when the nut 36*a* is tightened.

An L-shaped discharge passage 34*a*3 is formed in the supporting bolt 34*a*. The L-shaped discharge passage 34*a*3 communicates with a central aperture of the bolt 35*a*5, which secures the supporting member 35*a*21 to the end of the supporting bolt 34*a*. Thus, a passage extends between the inside and the outside of the work piece 30 through the supporting bolt 34*a*. In one configuration, the passages are positioned along the axial center of the respective components.

The discharge passage 34*a*3 communicates with a discharge passage 71*a* formed in a coupler 71. The coupler can be disposed at a tip of the cross member 34*a*2 of the supporting bolt 34*a*. Other configurations also can be used. A washer 31*a* can be used to close an end of the U-shaped groove 33*a*3. Thus, the axial end of the illustrated end cap 31 can have a recessed groove 33*a*3 that is generally enclosed by the washer 31*a*.

The illustrated coupler 71 comprises an opening and closing valve 72 that can be used to open and close the discharge passage 71*a*. In the illustrated arrangement, however, the pressure receiving coupler 70 has a check valve 70*a* such that flow can be generally limited to one direction while the coupler 71 is constructed without a check valve such that flow can freely occur in both directions. When the coupler 71 has the valve 72 in an open position, the inner chamber of the work piece 30 can be maintained at substantially ambient pressure.

Also, in the illustrated configuration, a groove 35*a*51 is defined in a side surface of the hexagonal head of the bolt 35*a*5 of the supporting member 35*a*21. A cross aperture 35*a*52 communicates with the groove 35*a*51 and places the inside of the work piece 30 in fluid communication with the central aperture 34*a*3. Those grooves 35*a*51, 35*a*52 define an air ventilation passage 35*a*53.

When both ends of the work piece 30 are tightly closed by the end caps 31, 32, the work piece can be filled with a suitable fluid, such as water. The fluid can be added through the pressure receiving coupler 70 with the work piece 30 extending generally parallel with the floor. Because air around the hexagonal head of the bolt 35*a*5 is discharged through the air ventilation passage 35*a*53, the discharge passage 71*a* and the coupler 71, almost all of the air in the work piece 30 can be discharged outside. Once almost no air remains in the work piece 30, and the fluid, fills the internal cavity of the work piece 30, a bending process of the work piece 30 can be performed to make suitable bends in the middle region of the work piece 30.

Figure 5:
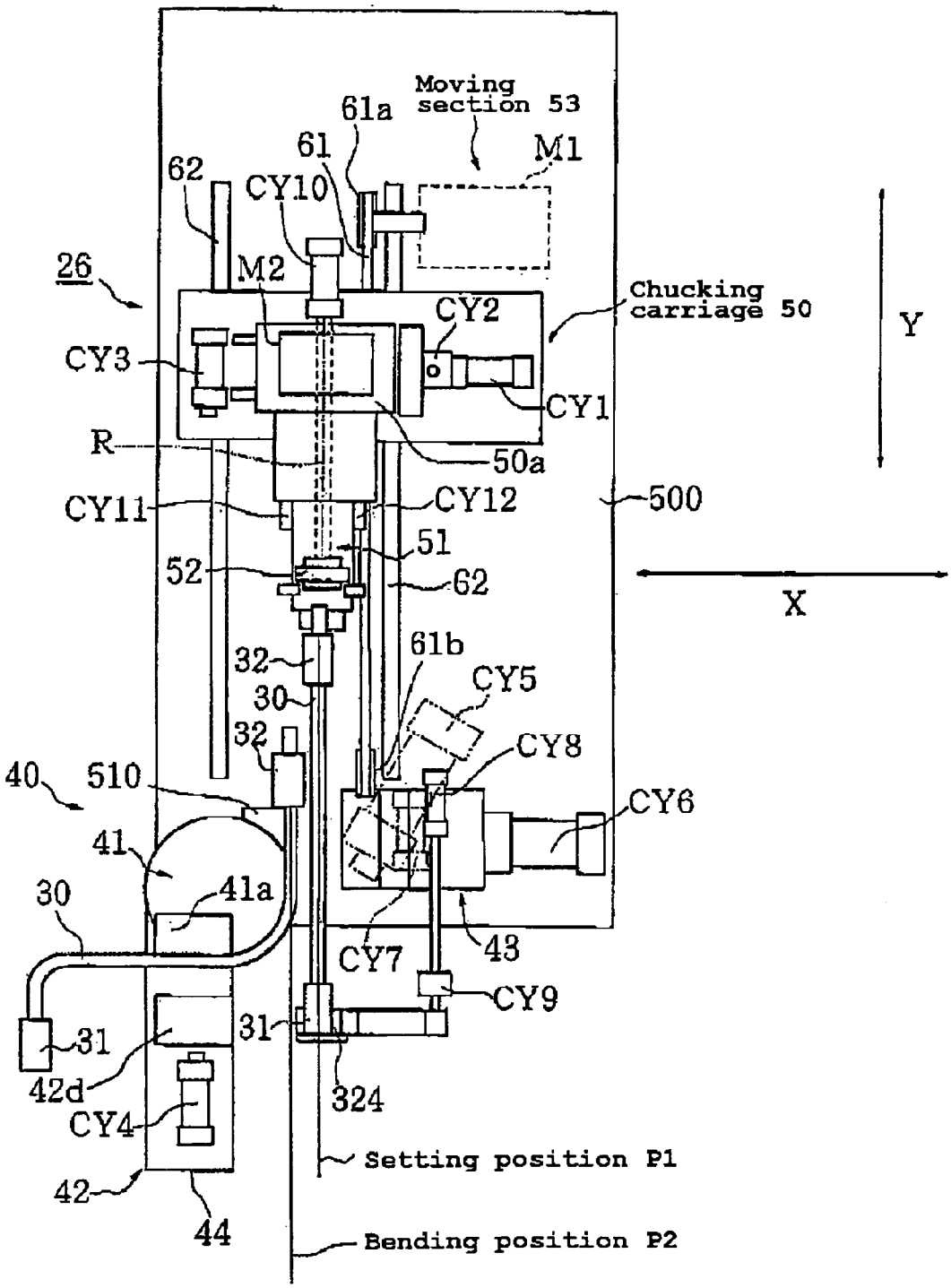
FIG. 5 is a schematic top plan view of a bending device with the work piece positioned in a setting position.

With reference now to FIGS. 5 through 20, a bending device 26 and a bending operation will be described in detail. The bending device 26 shown in FIGS. 5 through 8, for instance, generally comprises a bending machine 40 and a chucking carriage 50. In the illustration of FIG. 5, the chucking carriage 50 is largely positioned at the top of the drawing and the bending machine 40 is largely positioned at the bottom of the drawing.

The illustrated bending machine 40 generally comprises a bending section 41, a clamping section 42 and a pressing section 43, which is shown in FIG. 5 to the right of the bending section 41. In the illustrated configuration, the work piece 30 is interposed between a clamp receiver 41*a* of the bending section 41 and a clamp pusher 42*d*. The pressing section 43 presses in on the work piece 30 to hold it before the bending section 41 and the clamping section 42 pivot as a unit to bend the middle portion of the work piece 30.

In the illustrated configuration, the bending machine 40 comprises a number of hydraulic and air cylinders. A hydraulic cylinder CY4 clamps the work piece 30, which is interposed between the clamping section 42 and the bending section 41. A hydraulic cylinder CY5 rotates the clamping section support table to bend the middle portions of the work piece 30. During the bending process, a hydraulic cylinder CY6 drives the pressing section 43 to press and hold the work piece 30. A hydraulic cylinder CY7 is used to axially move a booster. An air cylinder CY8 is used to axially move a pipe receiving rack arm while another air cylinder CY9 is used to rotate the pipe receiving rack arm.

Figure 20:
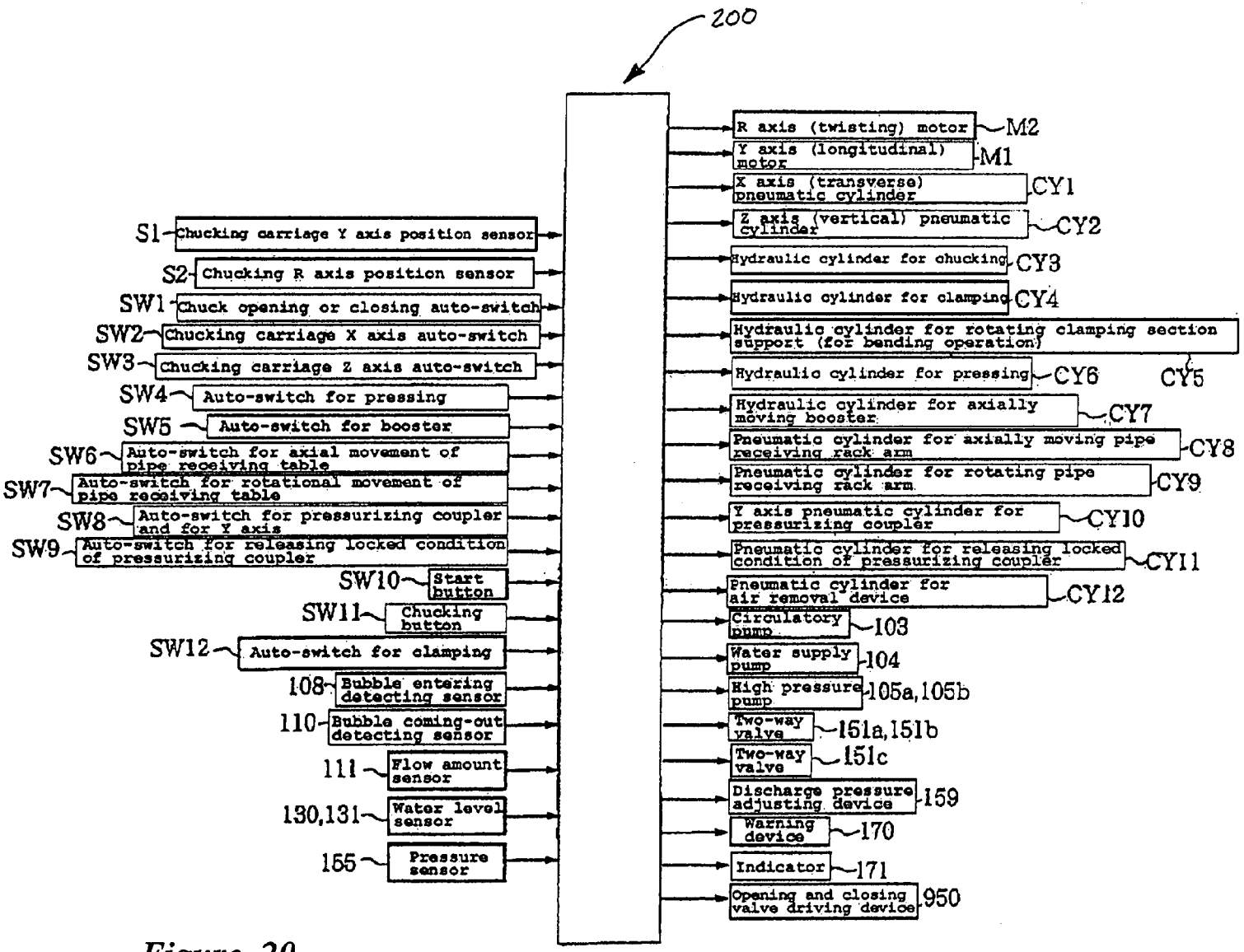
FIG. 20 is a block diagram for control of the bending device.

As shown in FIG. 20, a control device 200 drives those cylinders with ON signals from an auto-switch SW12 for clamping, an auto-switch SW4 for pressing, an auto-switch SW5 for the booster, an auto-switch SW6 for the axial movement of the pipe receiving table and an auto-switch SW7 for the rotational movement of the pipe receiving table. Other configurations also are possible.

The illustrated chucking carriage 50 comprises a chucking section 51. The chucking section 51 comprises a hydraulic cylinder CY3 that cantilevers the end cap 32 of the work piece 30. The chucking section 51 also comprises the pressurizing coupler 52, which was introduced above. The coupler 52 can be used to adjust or increase the internal pressure of the work piece 30 through the end cap 32. The illustrated chucking section 51 also comprises air cylinders CY1, CY2 that can move the pressurizing coupler 52 and the chucking section 51 together in an X axis direction and a Z axis direction. Preferably, a moving section 53 can also axially move the chucking carriage 50 in a Y direction. Thus, the illustrated chucking carriage 50 advantageously is capable of movement in all three dimensional directions. Other configurations also can be used.

The moving section 53 includes a Y axis (fore to aft) motor M1, a chain 61 driven by the Y axis (i.e., fore and aft) motor M1, and a pair of guide rails 62, 62. The Y axis (i.e., fore and aft) motor M1 rotates the chain 61 in a first or second direction. Thus, the chucking carriage 50 moves axially in the Y axis direction along the guide rails 62, 62. The chain 61 extends between a pair of sprockets 61*a*, 61*b*. The Y axis (i.e., fore and aft) motor M1 drives the first sprocket 61*a* or the second sprocket 61*b*. In the illustrated configuration, the motor M1 drives the first sprocket 61*a*. Other configurations, including those with a linear actuator or a gear train, also can be used.

The illustrated chucking carriage 50 has a twisting motor M2 that rotates about a central axis R of the chucking section 51. The twisting motor M2 rotates the work piece 30 so that a bending direction of the work piece 30 can be changed.

The X axis (transverse) air cylinder CY1 and the Z axis (vertical) air cylinder CY2 are connected to the chucking carriage 50. The X axis (transverse) air cylinder CY1 is attached to the chucking carriage 50 to move in a transverse direction a chucking table 50*a* on which the chucking section 51, the pressurizing coupler 52, the twisting motor M2 and the like are mounted. The Z axis (vertical) air cylinder CY2 moves the chucking table 50*a* in a vertical direction.

With reference now to FIG. 20, the control device 200 drives the Y axis (i.e., fore and aft) motor M1, the twisting motor M2, the X axis (transverse) air cylinder CY1 and the Z axis (vertical) air cylinder CY2 with ON signals from a chuck opening or closing auto-switch SW1, a chucking carriage X axis auto-switch SW2 and a chucking carriage Z axis auto-switch SW3 based upon position signals from a chucking carriage Y axis position sensor S1 and a chucking R axis position sensor S2.

The hydraulic cylinder CY3 also is attached to the chucking carriage 50. As shown in FIG. 20, the control device 200 drives the hydraulic cylinder CY3 with an ON signal from the auto-switch SW12 so that the chucking section 51 can be used to cantilever the end cap 32 that is mounted to the end portion of the work piece 30.

The illustrated chucking table 50*a* also comprises a Y axis air cylinder CY10 for the pressurizing coupler, an air cylinder CY11 that can be used to unlock the pressurizing coupler 52, if any, and an air cylinder CY12 that can be used as an air removal device. With reference to FIG. 20, the control device drives the cylinders CY10, CY11, respectively, with ON signals from an auto-switch SW8 for the pressurizing coupler and for Y axis movement and an auto-switch SW9 for unlocking the pressurizing coupler 52. Thus, the cylinders CY10, 11 and 12 can be used to connect the pressurizing coupler 52, to unlock the coupler 52 and to withdraw air.

Figure 6:
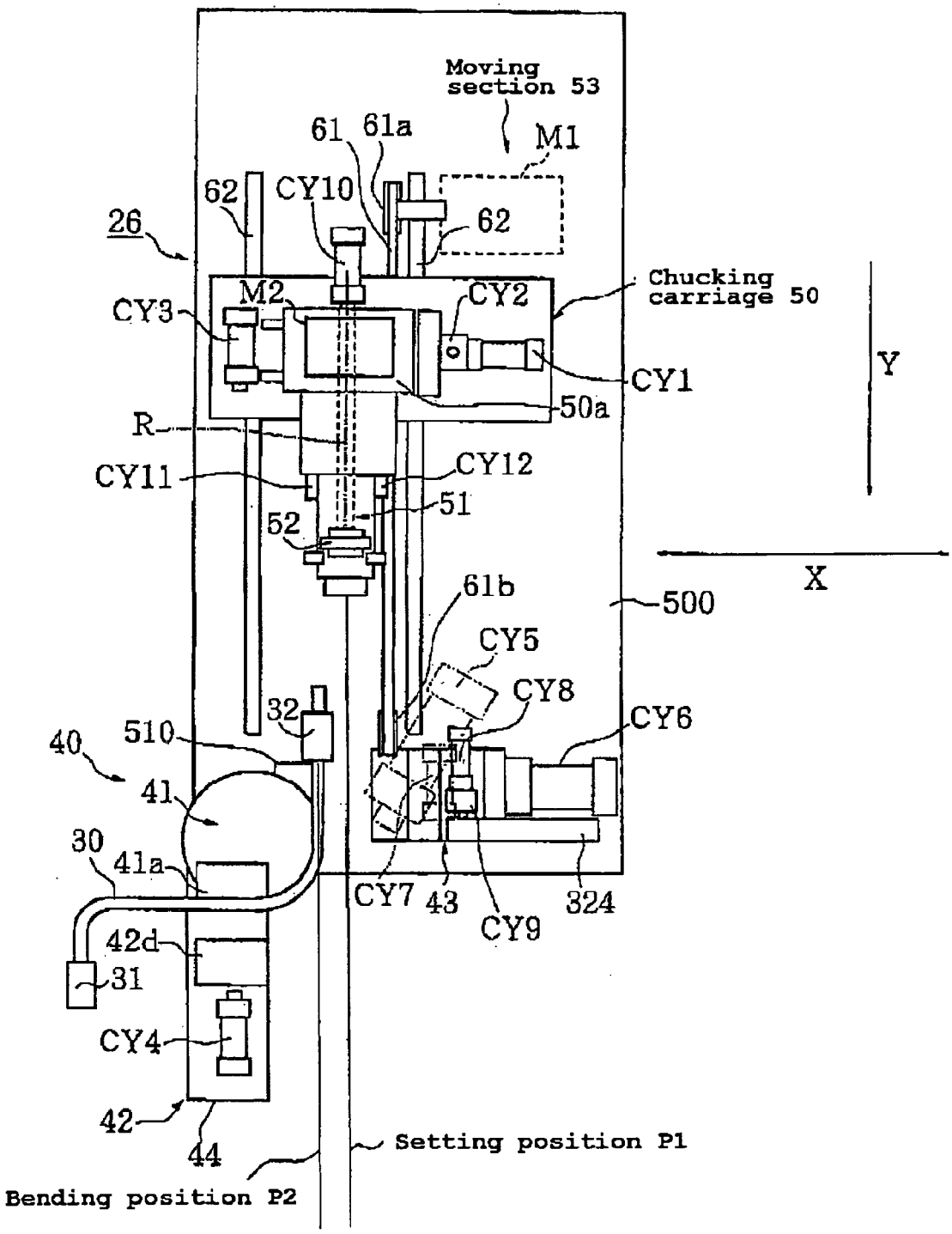
FIG. 6 is a schematic top plan view of the bending device after the work piece has completed a bending process.

In the illustrated bending device 26, the work piece 30 is moved from a setting position, such as that shown in FIG. 5, to a bending position, such as that shown in FIG. 6, to be bent. During bending, the chucking carriage 50 is moved forward (i.e., in the Y direction) and the pressurizing device 80 increases the internal pressure of the work piece 30 during bending. Afterwards, the cantilevering support of the work piece 30 by the chucking section 51 is released, the pressurizing coupler 52 is detached and the chucking carriage 50 is moved back.

As thus discussed, as the chucking carriage 50 moves back after the bent work piece 30 is wound around the bending section 41, the work piece 30 can be removed while the chucking carriage 50 is moving back because the cantilevering support by the chucking section 51 is released. While the chucking carriage 50 is moving back, the chucking table 50*a* moves to the setting position P1 from the bending position P2. Thus, the work piece 30 that is going to be bent next can be immediately loaded onto the chucking carriage 50, which results in improved productivity. Also, the work piece 30 that is going to be bent next can be loaded to the chucking section 51 of the chucking carriage 50 prior to the removal of the bent work piece 30 from the bending section 41, and a worker can move to a place for the next process while holding the work piece 30. Thus, the bent work piece does not need to be temporarily placed while a new work piece is being loaded onto the bending device.

Also, when the clamping section 42 releases the work piece 30, the bending section 41 and the clamping section 42 are still in the positions where the sections 41, 42 rotated to effect the bending of the work piece 30, the chucking table 50*a* has been moved in the direction of the X or Z axis to be placed at the setting position P1, and the new work piece 30 has been loaded onto the chucking section 51. Thus, prior to detaching the bent work piece 30 from the bending section 41, the worker can push the start button SW10, and the ON signal of the button SW10 makes the clamping section 42 together with the bending section 41 pivot about 90 degrees counterclockwise to return to the initial positions thereof, and the work piece 30 that is going to be bent next is automatically clamped. Thus, the worker can immediately (before the clamping section 42 returns to the initial position thereof) move to the place for the next process while holding the work piece 30 after the worker pushes the start button SW10. As a result, in comparison with earlier embodiments (i.e., the worker pushes the start button SW10, returns the clamping section 42 to the initial position thereof from the position shown in FIG. 5 before loading the next work piece for bending onto the chucking section of the chucking carriage, and then pushes the start button again to begin the bending process), the time during which the worker is required to remain next to the bending machine and the time interval between the completion of bending and the placement of the next work piece can be reduced, which improves productivity.

Following bending, after the clamp pusher 42*d* of the clamping section 42 has moved back, the internal pressure of the work piece 30 is decreased and then the cantilevering support by the chucking section 51 is released and the chucking carriage 50 moves back. Next, the pressing section 43 is retracted. The pressing section 43 thus presses and holds the work piece 30 when the chucking carriage 50 moves back in the Y direction. Therefore, the work piece 30 is not likely to be pulled by the chucking section 51 of the chucking carriage 50, which could result in undesired deformation of the final work product.

In the illustrated embodiment, the pressurizing coupler 52 is capable of moving towards or away from the chucking carriage 50. Preferably, the pressurizing coupler 52 moves away from the chucking carriage 50 prior to the retreat of the chucking carriage 50. Thus, the end cap 32 of the work piece 30 and the pressurizing coupler 52 can be detached from each other. The pressurizing coupler 52 can be detached by the retreat of the chucking carriage 50, which, because the detachment of the pressurizing coupler 52 does not need to be done independently, increases productivity.

Further, in order to connect the coupler 52 and the end cap 32, the pressurizing coupler 52 can be moved forward before the chucking carriage 50 moves forward. Thus, the internal cavity of the work piece 30 can be coupled to the pressurizing device 80, which allows the internal pressure of the work piece 30 to be adjusted before or during the forward movement of the chucking carriage 50, and the internal pressure of the work piece 30 can be continuously increased while the chucking carriage 50 moves forward. Thus, the internal pressure of the work piece 30 can continue to be increased or otherwise adjusted while the chucking carriage 50 moves forward. Therefore, at least a portion of the time, if not all of the time, that is necessary for increasing the internal pressure of the work piece 30 can be overlapped with the time that is necessary for the chucking carriage 50 to move forward, which results in further improved productivity.

In the illustrated bending device 26, the chucking section 51 defines a portion of the chucking table 50*a*. As shown in FIGS. 9 through 14, a chucking cylinder 301 is fixed to a chucking body 300 of the chucking section 51. Chucking claws 301*a*, which can be defined by one or more slits (not shown) at the tip of the chucking cylinder 301, engage with and hold the end cap 32 of the work piece 30. In one preferred arrangement, the claws 301*a* can be defined by four slits that extend through the tip of the chucking cylinder 301 but other numbers of slits can also be used. In the illustrated embodiment, four slits provide four fingers that are divided into two pairs with each pair providing a compressive clamping force.

Figure 10:
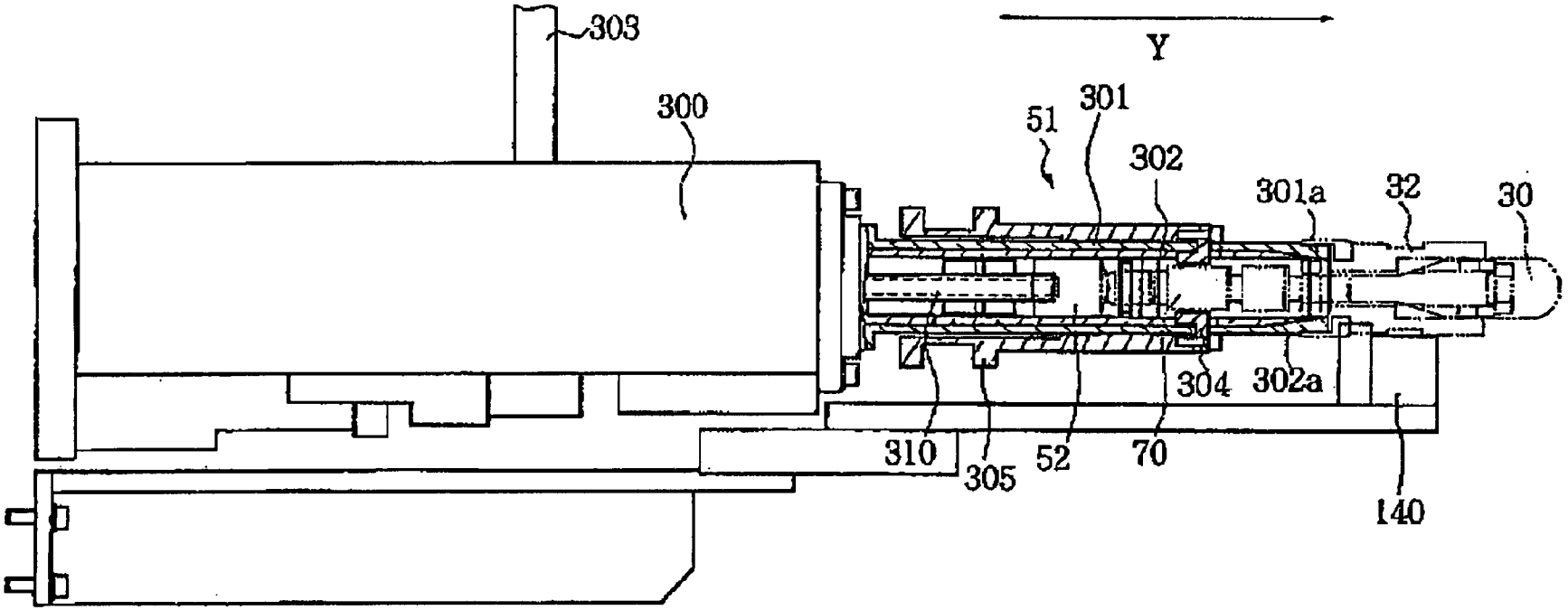
FIG. 10 is an enlarged cross sectional view of a portion of the chucking section.
Figure 11:
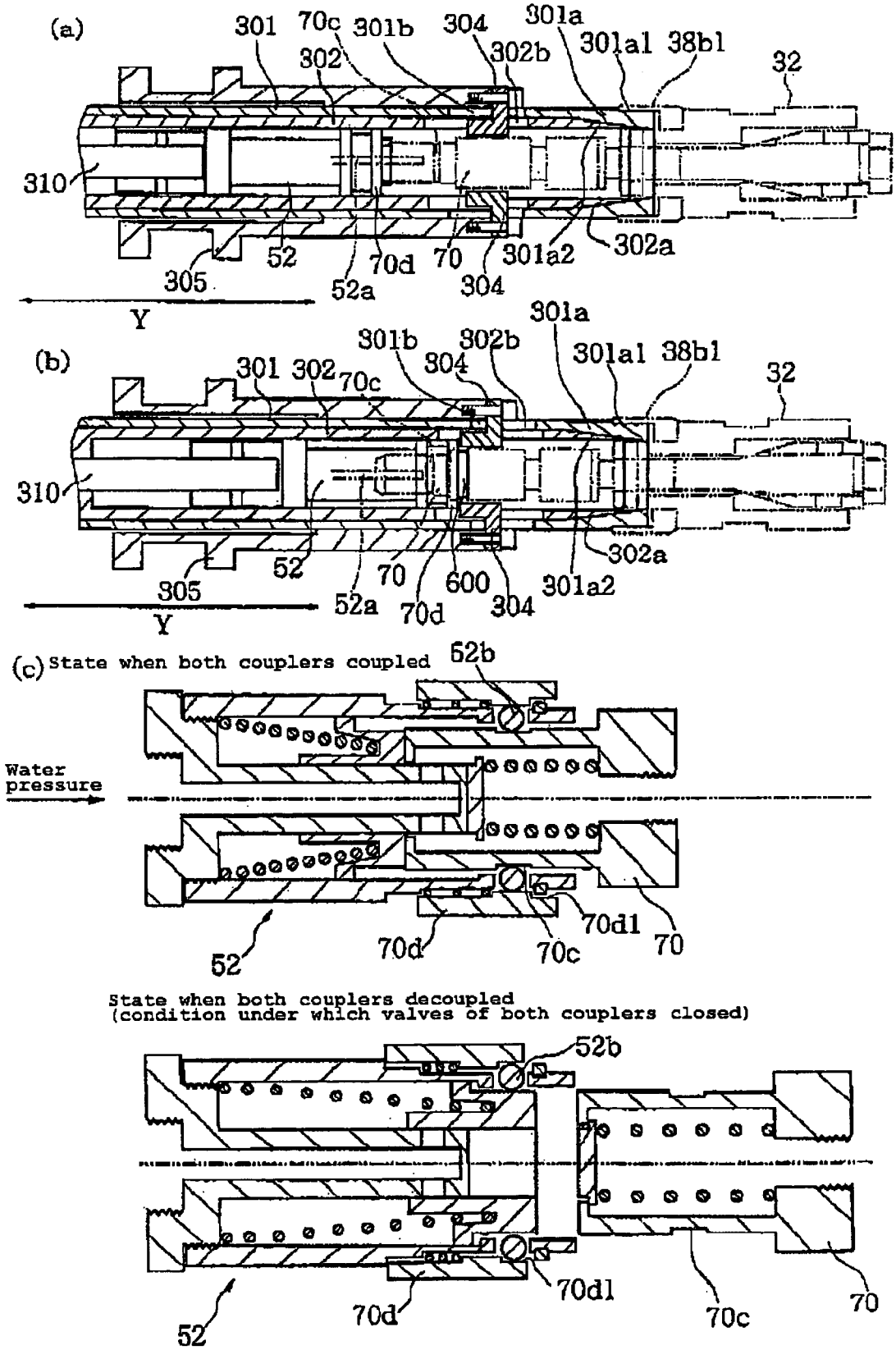
FIGS. 11(*a*), 11(*b*) and 11(*c*) are cross sectional views that show a work piece being chucked.

With reference now to FIG. 11, each of the illustrated chucking claws 301*a* preferably has an engaging step 301*a*1 formed at its outside perimeter and a tapered surface 301*a*2 formed at its inside perimeter. The coupling member 38*b*1 of the end cap 32 engages the steps 301*a*1 of the respective chucking claws 301*a* while the tapered surfaces 301*a*2 of the respective chucking claws 301*a* abut on the tip of a holding cylinder 302. A tapered surface 302*a* of the holding cylinder 302 contacts the tapered surfaces 301*a*2 of the respective chucking claws 301*a* when an operational lever 303 (see FIG. 10) connected to the holding cylinder 302 is operated by the hydraulic cylinder CY3. Thus, the chucking claws 301*a* expand outward and into tight engagement with the inner surface of the coupling member 38*b*1. In other words, the outer circumferential surfaces of the respective chucking claws 301*a* are pressed to an inner surface of the coupling member 38*b*1 of the work piece end cap 32 to secure the work piece 30 to the chucking section 51.

The pressure receiving coupler 70 of the end cap 32 is connected to the pressurizing coupler 52. A pair of pressing members 304, 304 is axially movable relative to a pair of guide holes 301*b*, 301*b* formed axially on the chucking cylinder 301 and a pair of guide holes 302*b*, 302*b* formed axially on the holding cylinder 302. The pressing members 304, 304 are attached to a sliding cylinder 305 fitted onto the chucking cylinder 301.

The pressurizing coupler 52 extends through the Y axis air cylinder CY10. An operational conduit 310, which can be fixed to a piston (not shown), moves the pressurizing coupler 52 in the Y axis direction (i.e., fore and aft). In the illustrated configuration, the pressuring coupler 52 moves back when the work piece 30 is being set and moves forward after the work piece 30 is set.

As shown in FIG. 11(*a*), the Y axis air cylinder CY10 preferably remains stationary when the work piece 30 is set. The pressurizing coupler 52 also preferably remains in its retreat position. The Y axis air cylinder CY10 is moved forward after the work piece 30 is properly positioned. The operational conduit 310 moves in the Y axis direction (forward) so that the pressurizing coupler 52 is connected to the pressure receiving coupler 70 of the end cap 32. As shown in FIG. 11(*c*), which generally corresponds to the coupling condition of both of the couplers, stopper balls 52*b* of the pressurizing coupler 52 engage with grooves 70*c* of the pressure receiving coupler 70 when the coupler 52 is joined to the coupler 70.

In order to uncouple the pressurizing coupler 52, the air cylinder CY11 is operated. The pressing members 304, 304 are moved rearward in the Y direction by the sliding cylinder 305 to press a ball pressing ring 70*d*. As shown in FIG. 11(*c*), which corresponds to the uncoupling of the couplers 52, 70, the Y axis air cylinder CY10 is operated once the ball pressing ring 70*d* has been retracted. The operational conduit 310 then is retracted, which uncouples the pressurizing coupler 52 from the pressure receiving coupler 70 of the end cap 32.

As thus described, the end cap 32 comprises the pressure receiving coupler 70, while the chucking section 51 comprises the pressurizing coupler 52. The combination of these couplers 70, 52 enable the internal pressure of the work piece 30 to be changed while allowing the two couplers to be detachably coupled. As shown in FIG. 11(*a*), before the end portion of the work piece 30 is set to the chucking section 51, which is used to cantilever one end portion, the pressurizing coupler 52 is in the retreat position relative to the pressure receiving coupler 70. By keeping the pressurizing coupler 52 in the retreat position relative to the pressure receiving coupler 70, the work piece 30 can be easily positioned in the chucking section 51.

Figure 9:
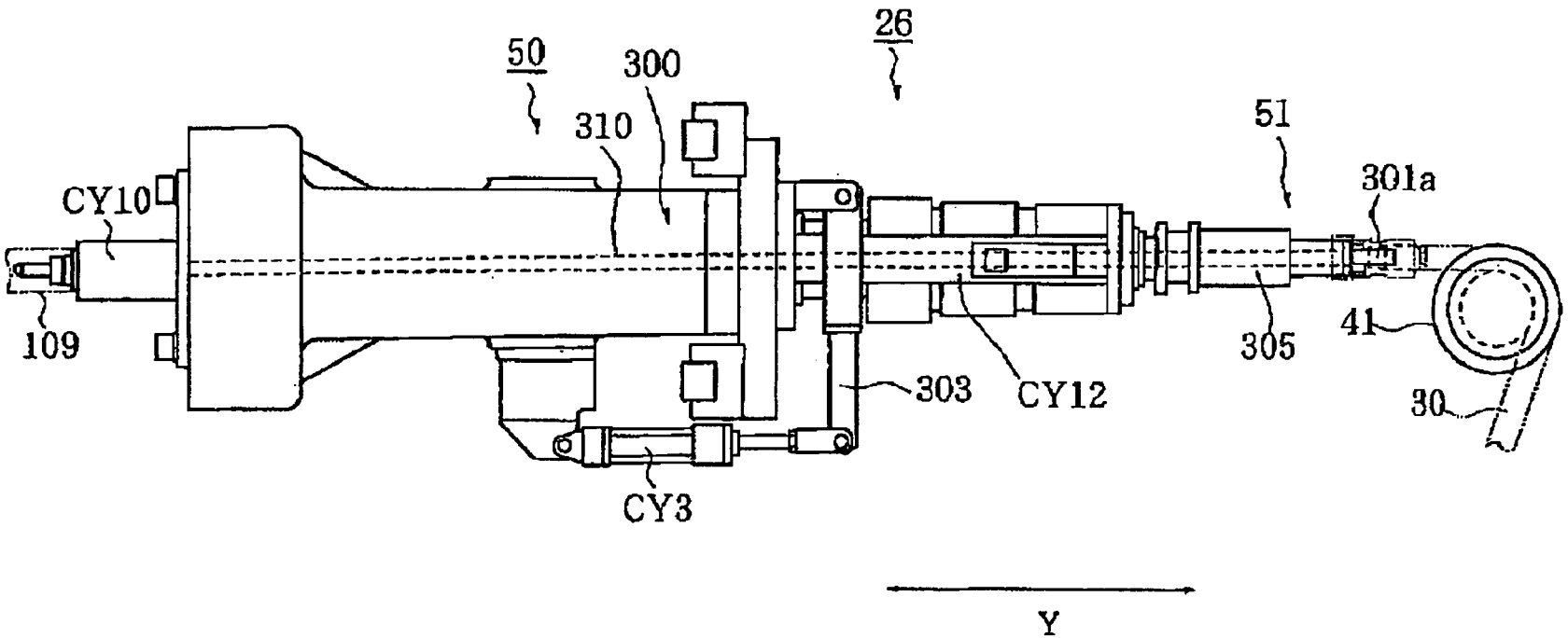
FIG. 9 is a top plan view of a chucking section.

The pressurizing coupler 52 has a pin 52*a* that pushes the check valve 70*a* of the pressure receiving coupler 52 out of the way as the two couplers 52, 70 are brought together. As shown in FIG. 11(*c*), the pressurizing coupler 52 incorporates stopper balls 52*b* in such a manner that the stopper balls 52*b* are retained by a retaining recess 70*d*1 of the ball pressing ring 70*d* to be movable in the radial direction. The stopper balls 52*b* are fitted in the groove 70*c* of the pressure receiving coupler 70 so that the pressurizing coupler 52 and the pressure receiving coupler 70 can be secured together. As shown in FIG. 9, a pressurizing conduit 109, which capable of withstanding high pressures, is connected to the operational conduit 310 of the pressurizing coupler 52.

The pressurizing coupler 52 is released from the pressure receiving coupler 70 before it is released from the chucking carriage 50 following bending. At this moment, the ball pressing ring 70*d* of the pressurizing coupler 52 retracts, and the stopper balls 52*b* move outward in the radial direction. When the chucking carriage 50 moves back under this condition, the pressurizing coupler 52 is released.

Upon fitting the work piece 30 to the chucking carriage 50 using a human hand and pushing the chucking button SW11, the pressurizing coupler 52 is moved by the operational conduit 310 of the Y axis air cylinder CY10 in the Y axis direction (forward) to be coupled with the pressure receiving coupler 70. The chucking claws 301*a* expand following the operation of the hydraulic pressure cylinder CY3 for chucking to strongly cantilever the work piece 30 from the inside.

Figure 12:
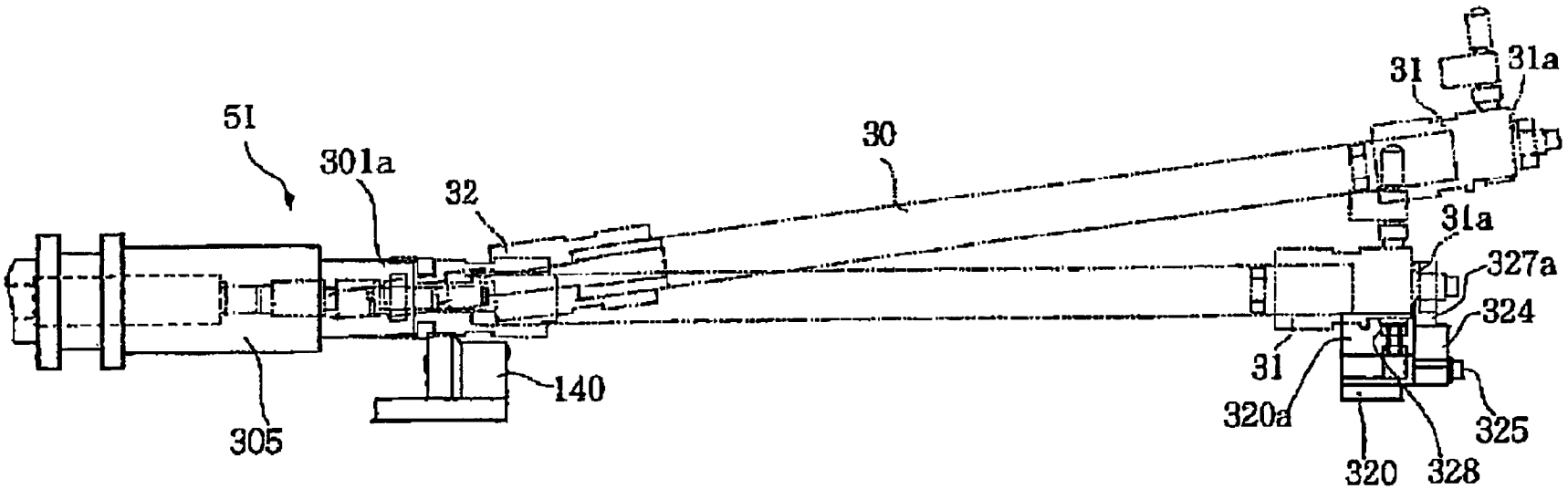
FIG. 12 illustrates a setting of the work piece.

With reference to FIGS. 10 and 12, a receiving rack 140 is fixed proximate to the chucking body 300. In some configurations, the receiving rack 140 is fixed directly to the chucking body 300. The receiving rack 140 is arranged so that the end cap 32 can be properly positioned in the X axis direction and the Y axis direction. Thus, the receiving rack 140 can enable easy and precise positioning of the work piece 30 in general and the end cap 32 specifically.

Figure 13:
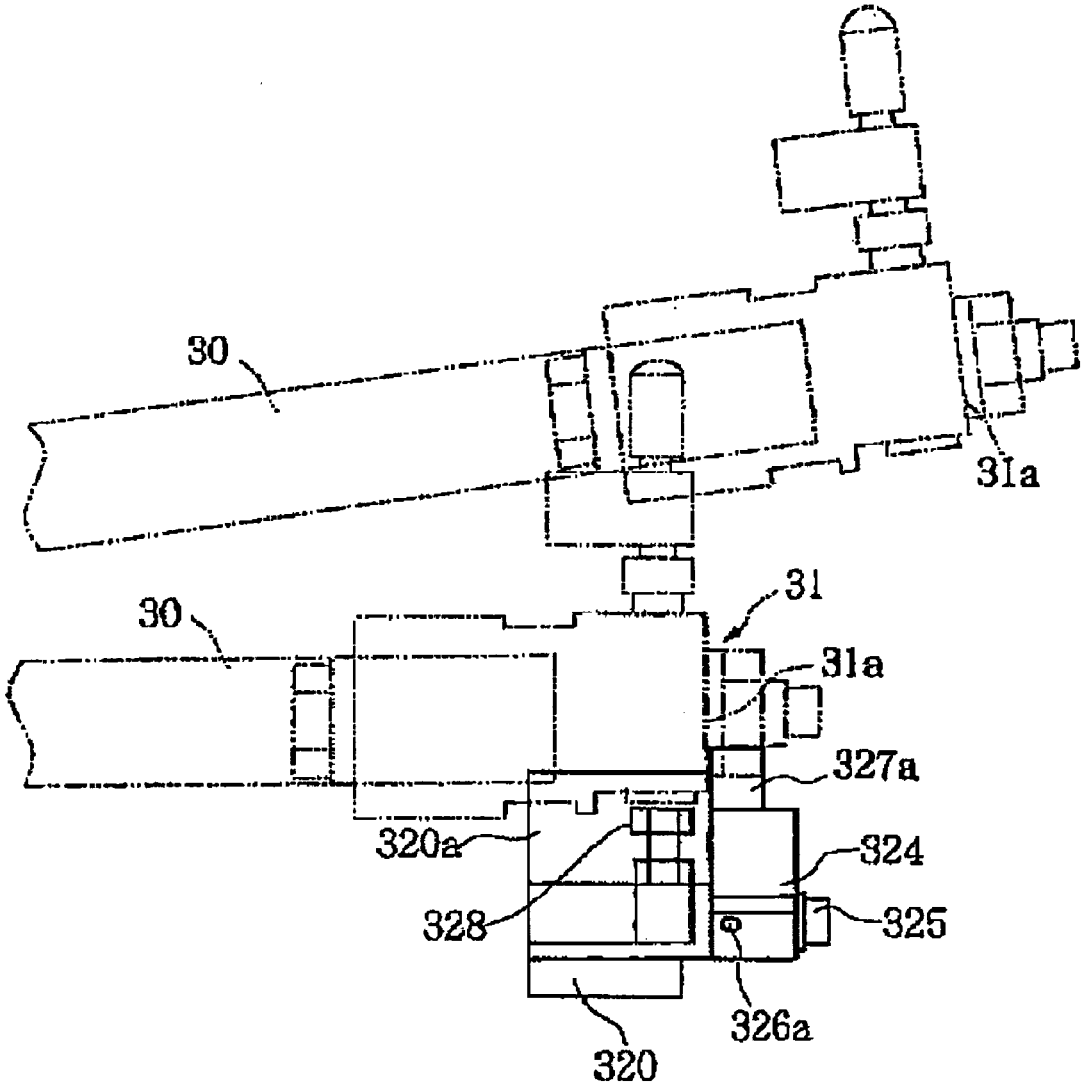
FIG. 13 is a front elevation view showing the work piece being supported.
Figure 14:
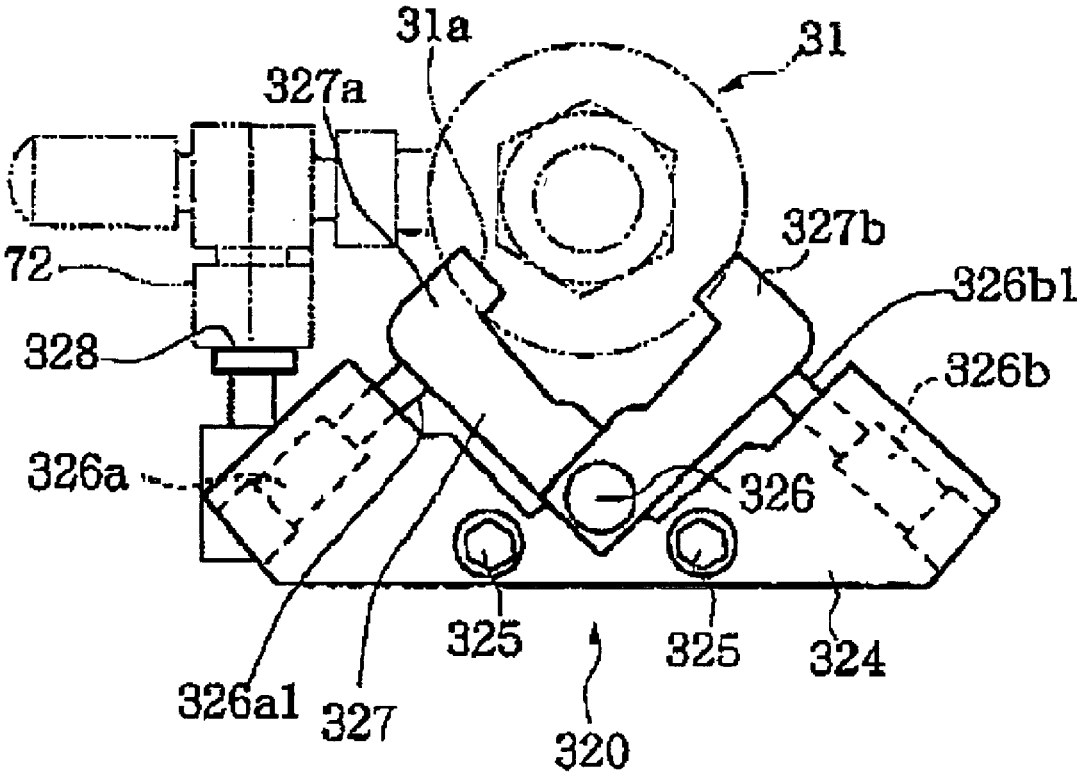
FIG. 14 is a side elevation view showing the work piece being supported.

As shown in FIGS. 12 through 14, the end cap 31 at the other end of the work piece 30 can be held by a receiving rack arm 320 that is disposed proximate to a receiving rack body 321 of the bending machine 40. In some configurations, the receiving rack arm 320 and/or the receiving rack body 321 (see FIG. 15) can be mounted directly to the bending machine 40. The illustrated receiving rack arm 320 pivots about an axis of a drive shaft 322, as a fulcrum, that is disposed at the receiving rack body 321 (see FIG. 15). The drive shaft 322 is operated by the air cylinder CY9. In one configuration, the air cylinder CY9 rotates the drive shaft 322. Also, the receiving rack body 321 is movable in the Y axis direction (fore to aft) relative to a bending machine body 400 when driven by the air cylinder CY8 for axially moving a pipe receiving rack arm. In one configuration, the air cylinder CY9 also is moved in the axial direction by the air cylinder CY8.

With reference now to FIG. 13, the end of the illustrated receiving rack arm 320 has a supporting portion 320*a* and a stopper portion 324. In the illustrated configuration, the stopper portion 324 is secured in position by a threaded fastener, such as a screw 325. Other suitable configurations also can be used. A receiving unit 327 is fixed to the stopper portion 324, also by a screw 326 in the illustrated configuration, although other suitable configurations can be used.

With reference to FIG. 14, the receiving unit 327 comprises engaging claws 327*a*, 327*b*. The illustrated claws 327*a*, 327*b* extend at generally right angles but can extend in other directions as desired. Accordingly, screw plugs 326*a*, 326*b* can be provided to adjust the generally 90 degree interposing angle of the engaging claws 327*a*, 327*b*. Each of the illustrated screw plugs 326*a*, 326*b* comprises a pin 326*a*1, 326*b*1 that can be gently biased, such as by a spring (not shown), and that can be controlled with respect to the extent that it projects toward the respective claw 327*a*, 327*b*. The pins 326*a*1, 326*b*1 support the respective engaging claws 327*a*, 327*b*. With the incorporation of the biasing feature, the engaging claws 327*a*, 327*b* can expand outward (i.e., rotate further away from each other) to broaden the angle defined between each other to more than 90 degrees when the end cap 31 is being positioned on the chucking section 51. Thus, the axes of the work piece 30 and the chucking section 51 can be generally better aligned and placement of the work piece on the machinery can be simplified.

In the illustrated embodiment, the cylindrical portion of the end cap 31 is positioned on the supporting portion 320. Thus, even though the thicknesses and outer diameters of various work pieces may differ, the end cap 31 is secured to the supporting portion 320*a* and there can, therefore, be consistency in the mounting of the work piece because the end cap 31 is consistently sized. Thus, the respective axes of the work piece 30 and the chucking section 51 can be generally aligned with each other when the work piece 30 is mounted on the supporting portion 320*a*.

With reference again to FIG. 13, the outer circumferential surface of the illustrated end cap 31 comprises a stopper 31*a* that regulates the movement of the work piece 30 in the Y axis direction (forward). The stopper 31*a*, which is disposed around the outer circumferential surface of the end cap 31, abuts on the engaging claws 327*a*, 327*b* of the stopper portion 324 to regulate the forward movement of the work piece 30 in the Y axis direction. Because of the regulation of the movement in the Y axis direction (forward), a reference position for each work piece 30 can be easily given. Thus, bending can be precisely performed with reduced time spent positioning the work piece 30 prior to beginning the bending of the work piece. Also, the axial forces generated during coupling of the pressurizing coupler 52 of the chucking section 51 and the pressure receiving coupler 70 disposed at the end cap 32 can be received by the engaging claws 327*a*, 327*b* of the stopper portion 324 via the stopper 31*a*.

Figure 15:
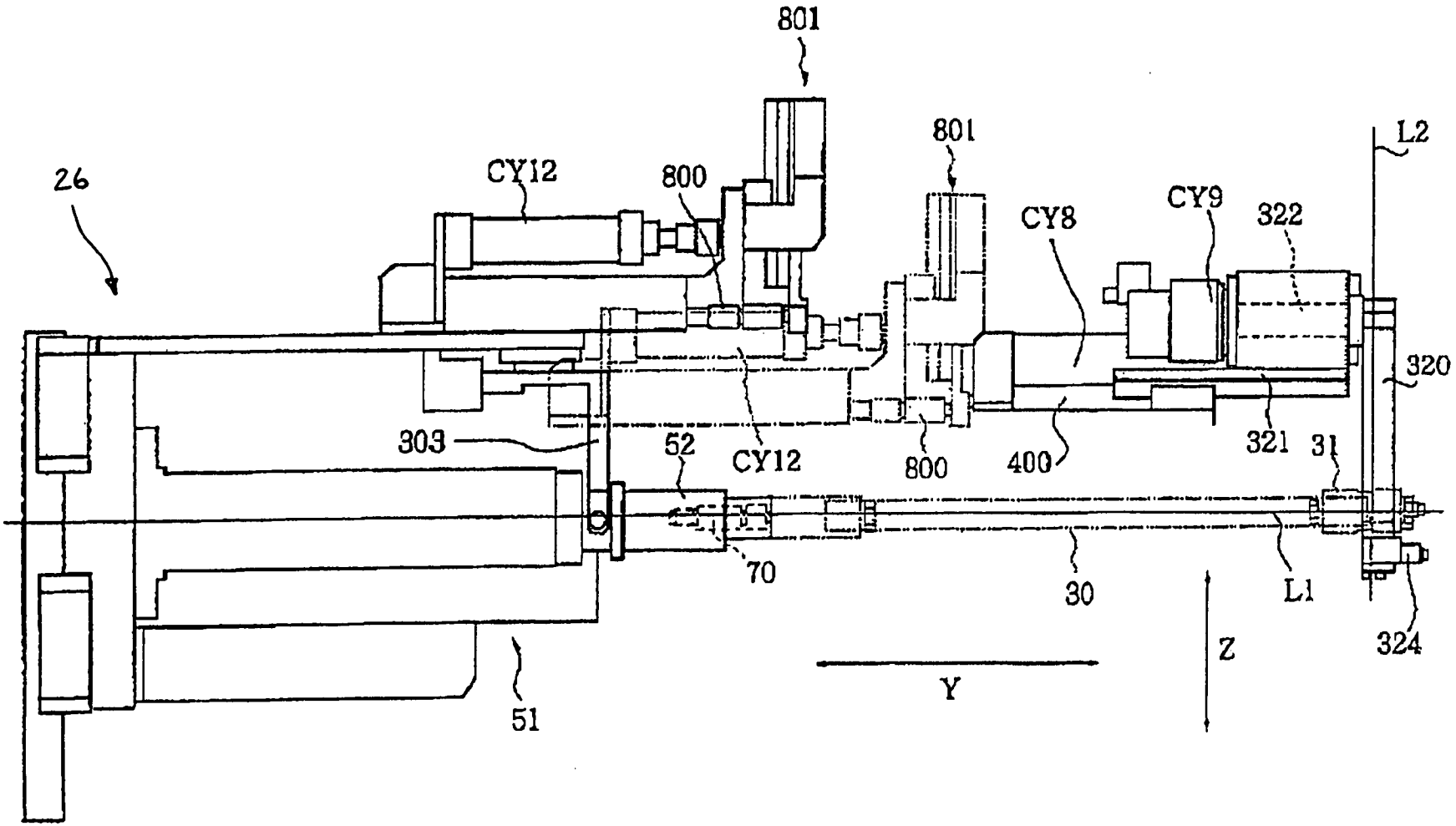
FIG. 15 is a front view of the bending device.
Figure 16:
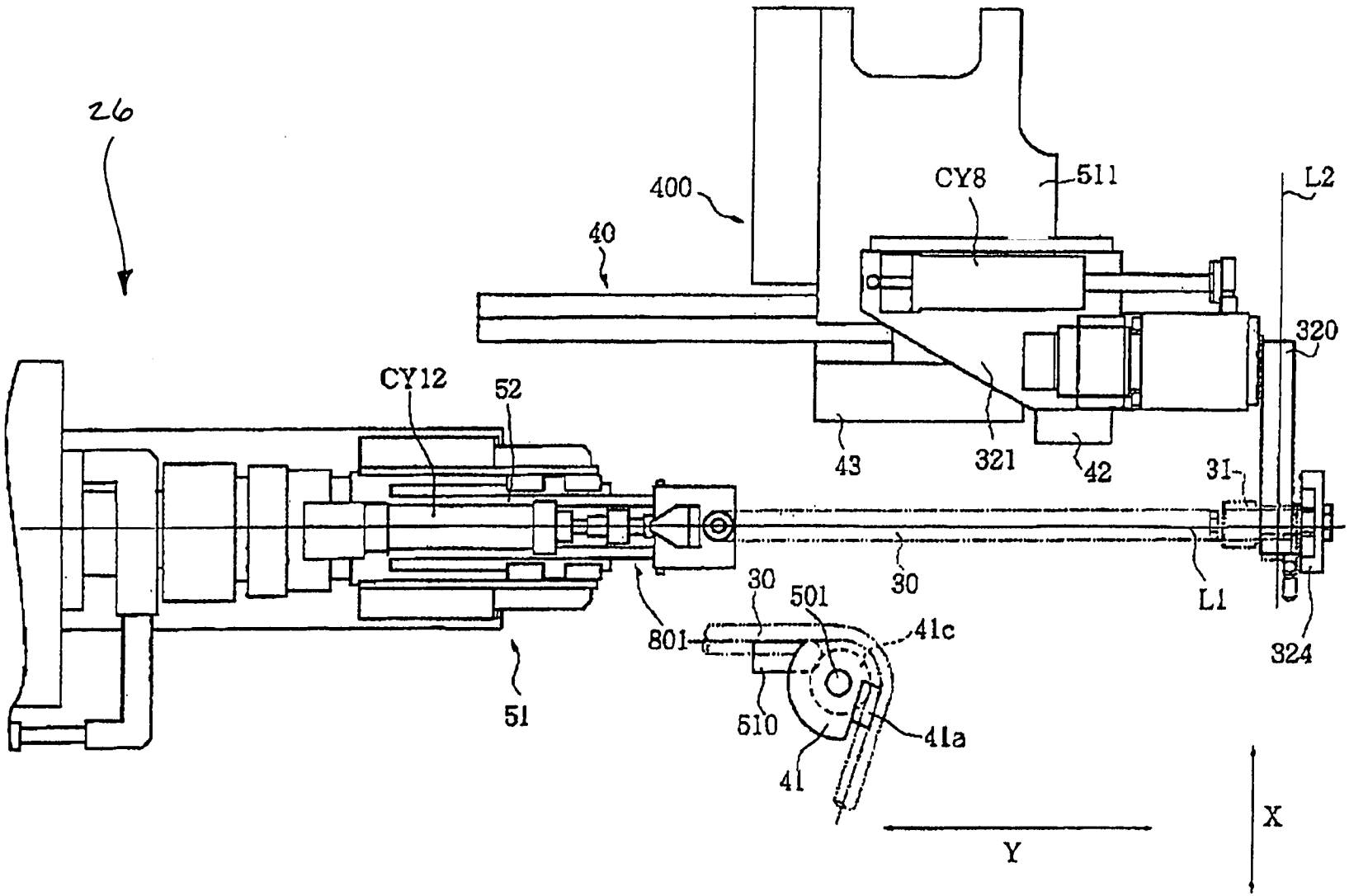
FIG. 16 is a top plan view showing the work piece being positioned on the bending device.
Figure 17:
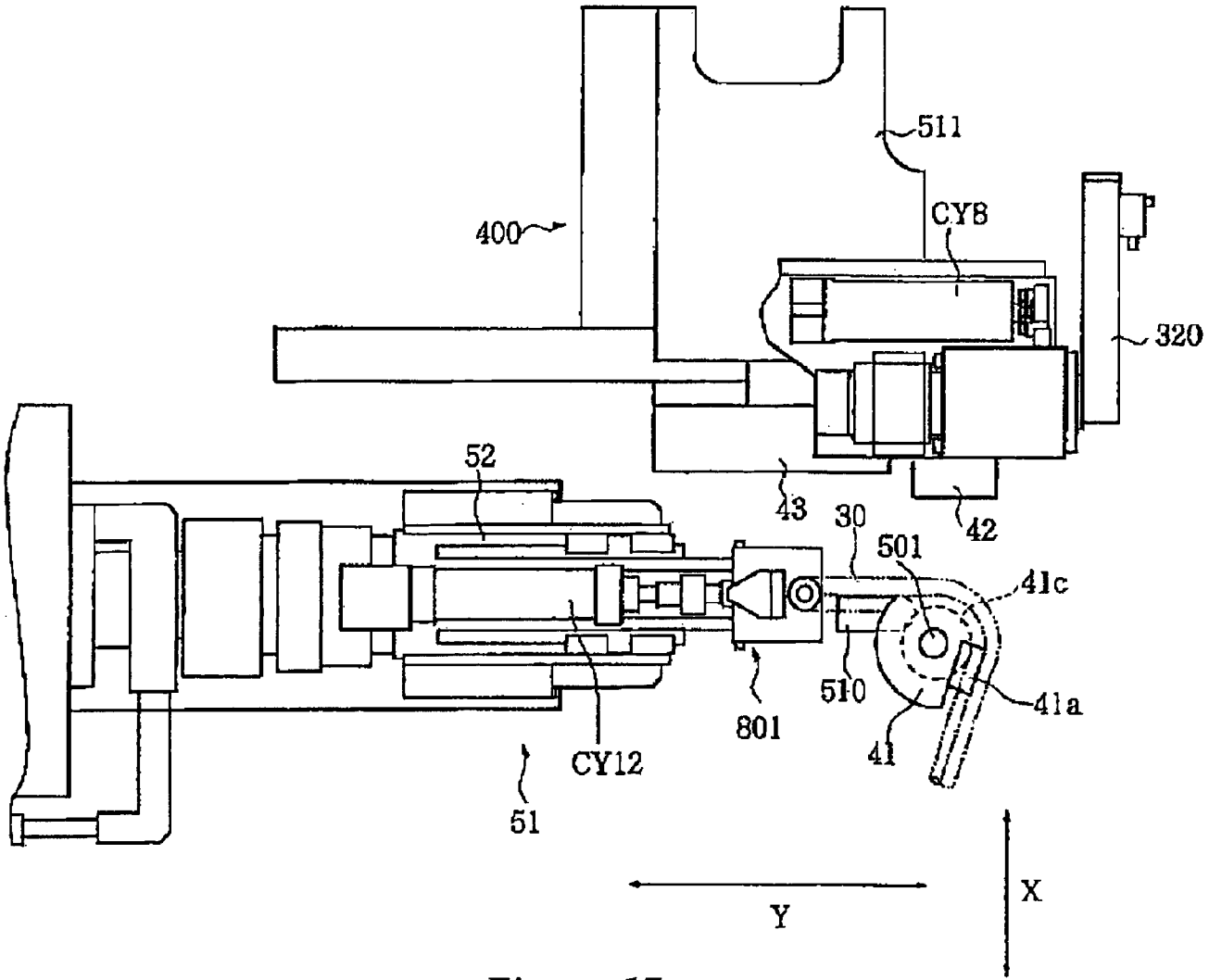
FIG. 17 is a top plan view illustrating the work piece being bent by the bending device.
Figure 18:
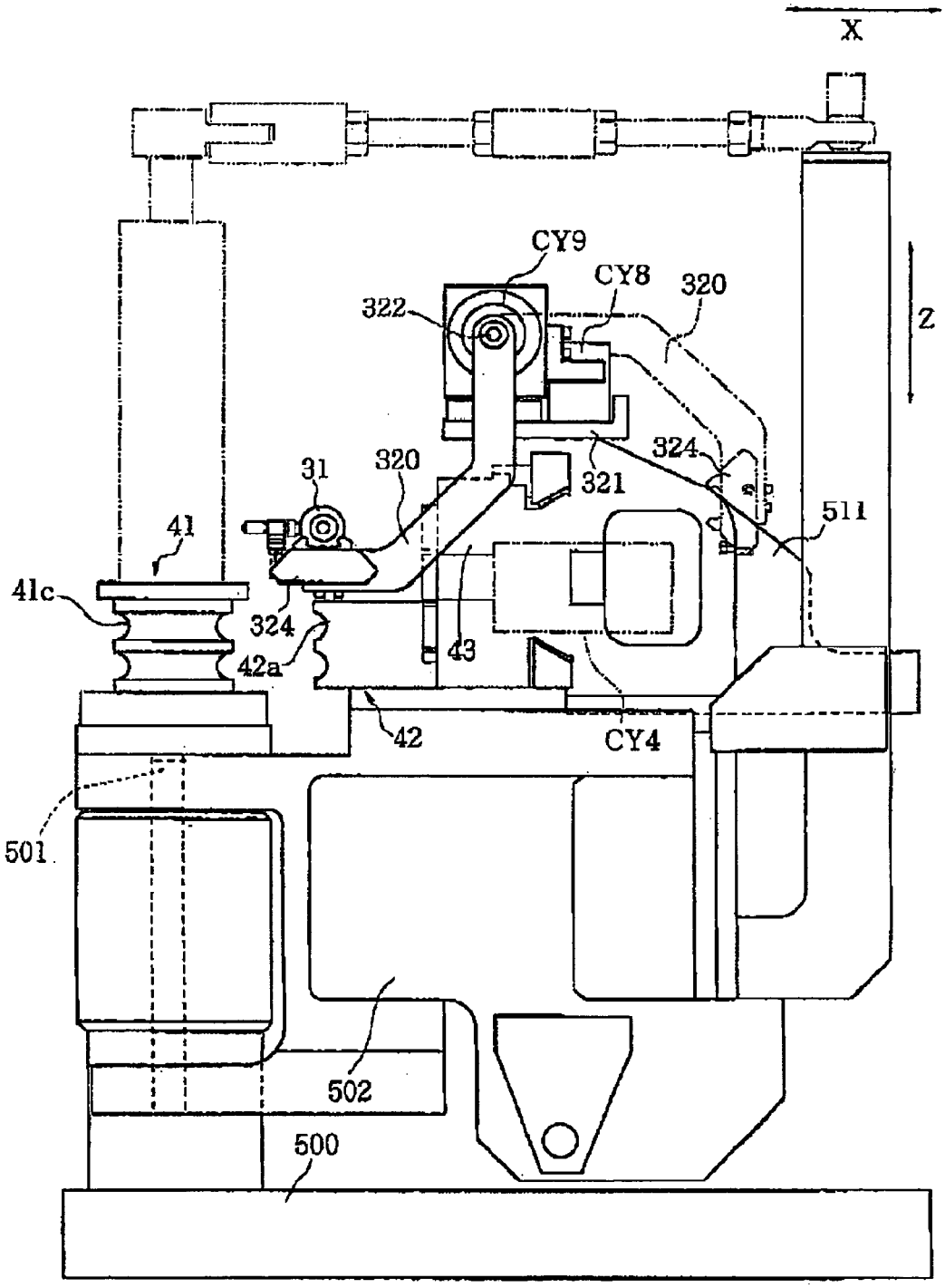
FIG. 18 is a side elevation view showing the work piece being positioned on the bending device.
Figure 19:
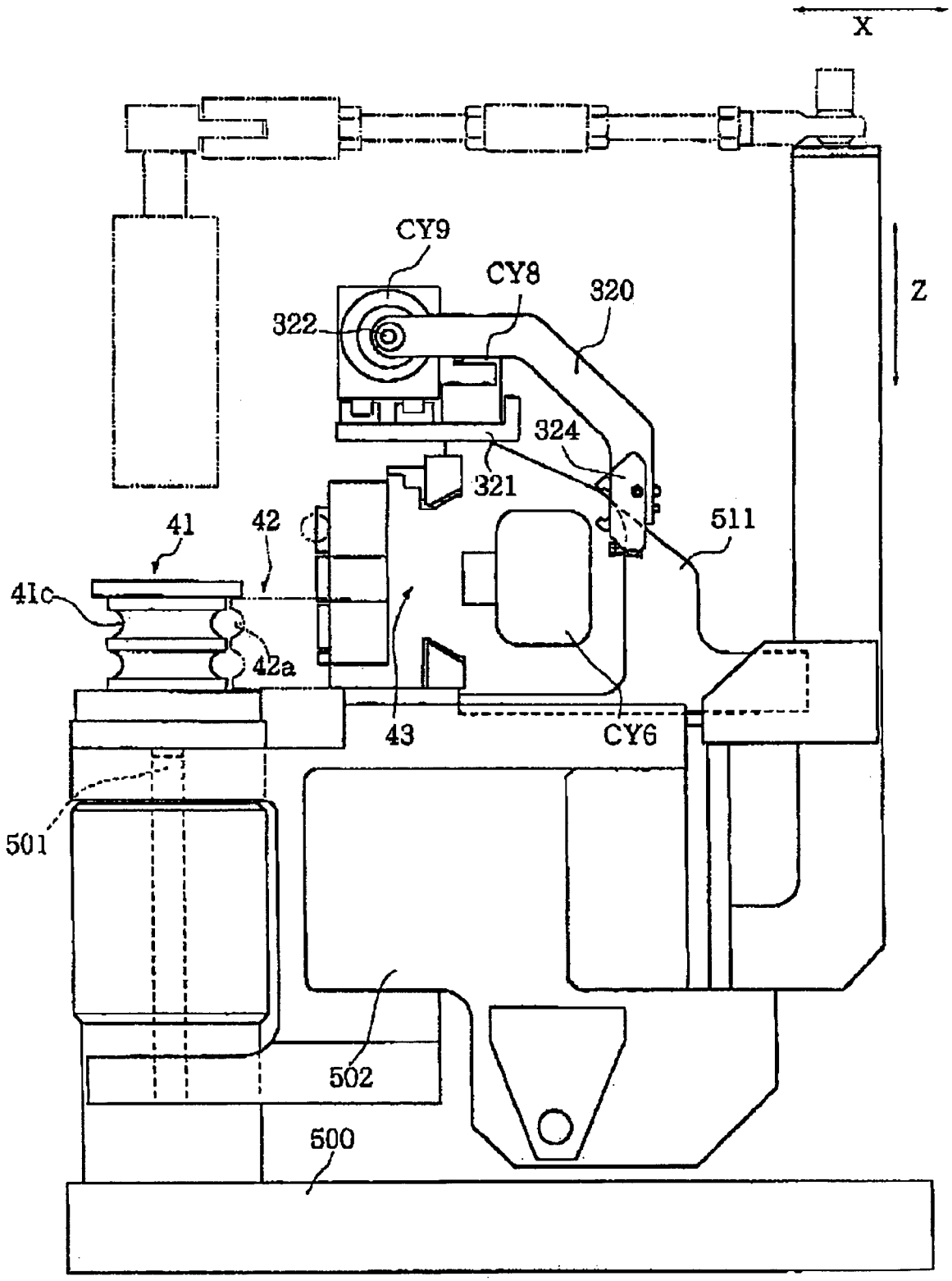
FIG. 19 is a side elevation view showing the work piece being bent by the bending device.

The receiving rack arm 320 can move between a setting position shown in FIGS. 15, 16 and 18 (indicated by the actual line) and a waiting position shown in FIGS. 17 and 18 (indicated by the two-dot-chain line).

Thus, the supporting portion 320*a* and the stopper portion 324 are movable in a direction L2 that extends generally normal to an axis L1 of the work piece 30 mounted on the supporting portion 320*a* and to a direction going away from the bending section 41, by the movement of the receiving rack arm 320. Because the supporting portion 320*a* and the stopper portion 324 together move away from the bending section 41 during the bending work of the work piece 30, the supporting portion 320*a* and the stopper portion 324 do not disturb the bending of the work piece 30.

The bending section 41, the clamping section 42 and the pressing section 43 of the bending machine 40 preferably are combined in a suitable manner, such as that shown in FIGS. 16 through 19. The bending section 41 comprises a clamp receiver 41*a* and a roll die (not shown). The bending section 41 is pivotable together with, or relative to, a center shaft 501. In the illustrated configuration, the center shaft 501 extends through a platform 500 in the Z axis direction.

The illustrated clamping section 42 comprises the clamp pusher 42*d* (see FIG. 7), the hydraulic pressure cylinder CY4 and a clamping section support 502 (see FIG. 18). The clamping section support 502, which comprises the clamp pusher 42*d*, can be unitarily combined with the bending section 41 in some preferred configurations. The clamping section support 502 can pivot together with, or relative to, the pivot center shaft 501. In one configuration, the clamping section support 502 is rotated by the hydraulic cylinder CY5 (see FIG. 5) for rotating the clamping section support (for the bending operation). The clamp pusher 42*d* can move forward to and backward from the bending section 41 through operation of the hydraulic pressure cylinder CY4, which is disposed on the clamping section support 502 (see FIG. 18).

In the bending process, the chucking carriage 50 moves forward in the Y axis direction in accordance with the deformation of the work piece 30. In this bending process, a groove 41*c* of the bending section 41 and a groove of the clamping section 42 capture the work piece 30 therebetween (see FIG. 8). Two sets of the groove 41*c* of the bending section 41 and the groove of the clamping section 42 are provided in the illustrated arrangement, but other numbers and configurations also can be used. The radius of curvature of the respective sets of the grooves 41*c*, 42*a* can differ from each other between the upper and lower grooves such that the different grooves can be used for different bends without having to replace the bending and clamping sections.

With reference to FIG. 18, a pressing section support 511 can be positioned adjacent to the bending section 41 of the platform 500. The pressing section support 511 can support the pressing section 43. The pressing section 43 can be moved forward or backward toward a wiper 510 (see FIG. 16) by the hydraulic cylinder CY6. The wiper 510 is fixed to the platform 500 adjacent to the roll die on the chucking carriage 50 side. The wiper 510 presses the work piece 30 together with the pressing section 43 when the pressing section 43 moves forward. In one configuration, the pressing section 43 and the wiper 510 squeeze the work piece 30 when the pressing section support 511 moves forward in the X axis direction, while they release it when the pressing section support 511 moves backward. Thus, the pressing section support 511 preferably is arranged to move in the X axis direction relative to the platform 500 and the pressing section 43 preferably is attached to the pressing section support 511 to be movable in the Y axis direction.

When the bending is completed, the clamping section support 502 stops at the bending completion position, and the clamp is released. The work piece 30 remains wound around the groove 41*c* of the bending section 41 although detachable therefrom. The pressing section 43 moves back in the X axis direction, and the support arm 320 pivots to set the supporting portion 320*a* at the setting position P1 in the X axis direction and the Z axis direction.

After bending is completed, the chucking carriage 50 has moved back to the retreat position in the Y axis direction. Thus, the one end of the work piece 30 is obliquely fitted onto the chucking section 51, and the other end thereof is mounted on the supporting portion 320*a*. Then, the work piece 30 is moved forward (approximately 1 mm) to abut on the engaging claws 327*a*, 327*b* of the stopper portion. Thereby, the work piece 30 can be precisely positioned in the Y axis direction. Next, the work piece 30 is rotated about its central axis to make the opening and closing valve 72 of the cap 31 abut on a rotation stopper bolt 328 indicated in FIG. 14. Thereby, the work piece 30 can be precisely positioned about the central axis. In addition, the welding beads formed when the work piece 30 is made from a plate material can be kept out from the bending plane in the bending process so that the work piece 30 is not likely to be damaged along the welding beads.

After the work piece 30 is precisely positioned in the Y axis direction by abutting on the engaging claws 327*a*, 327*b*, the support arm 320 pivots toward the waiting position with the ON signal of the start button pushed by the operator. The chucking section 51 of the chucking carriage 50 thus expands to cantilever the work piece 30. Afterwards, the chucking carriage 50 moves by a predetermined amount in the Y axis direction. Additionally, because the chucking carriage 50 moves by the predetermined amount in the Y axis direction, each bending position of the multiple bending portions in the axial direction can be more precisely controlled. Also, because the chucking section 51 pivots by a certain amount while the chucking carriage 50 moves in the Y axis direction, each bending position of the multiple bending portions about the central axis can be more precisely controlled.

The chucking section 51 moves in the X axis direction and further simultaneously moves in the Z axis direction; thereby, the work piece 30 can be positioned on any desired groove 41*c* of the bending section 41. Alternatively, in some structures of the bending machine 40, the chucking section 51 can move only in the Y axis direction, in the Y axis direction and the X axis direction, or in the Y axis direction and the Z axis direction. Furthermore, the bending section 51 can move in some embodiments (e.g., in the Z axis direction).

If the chucking section 51 can move only in the Y axis direction, the chucking section 51 preferably is sufficiently retracted to a position where it does not interfere with the previously bent work piece 30 so that the work product 30 can be set to the chucking section 51 prior to detachment from the bending section 41. Also, instead of the movement of the chucking section 51 in the X axis direction, it is practicable that the bending section 41 (including the clamping section support and a pivot shaft) can move forward or backward in the X axis direction.

If the chucking section 51 can move in the Y axis direction and can move in the Z axis direction, the roller of the bending section 41 can be multistage. In such a configuration, the respective grooves 41*c*, 42*a* of the multistage can differ from each other so that the outer diameter of each work piece can be changed, or the bending radius thereof can be changed, for example but without limitation.

Figure 7:
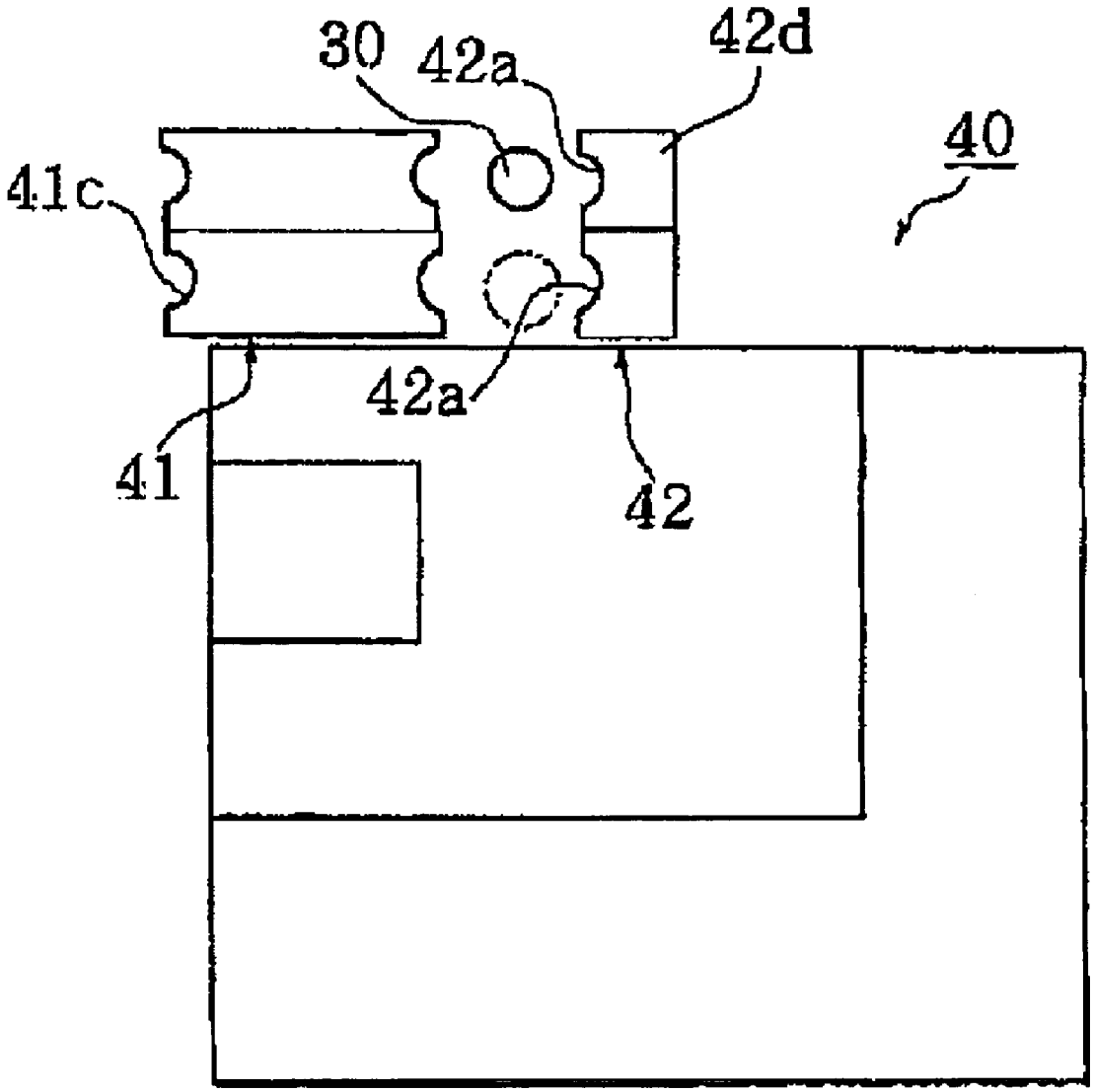
FIG. 7 is a side elevation view of a clamping section of the bending device.
Figure 8:
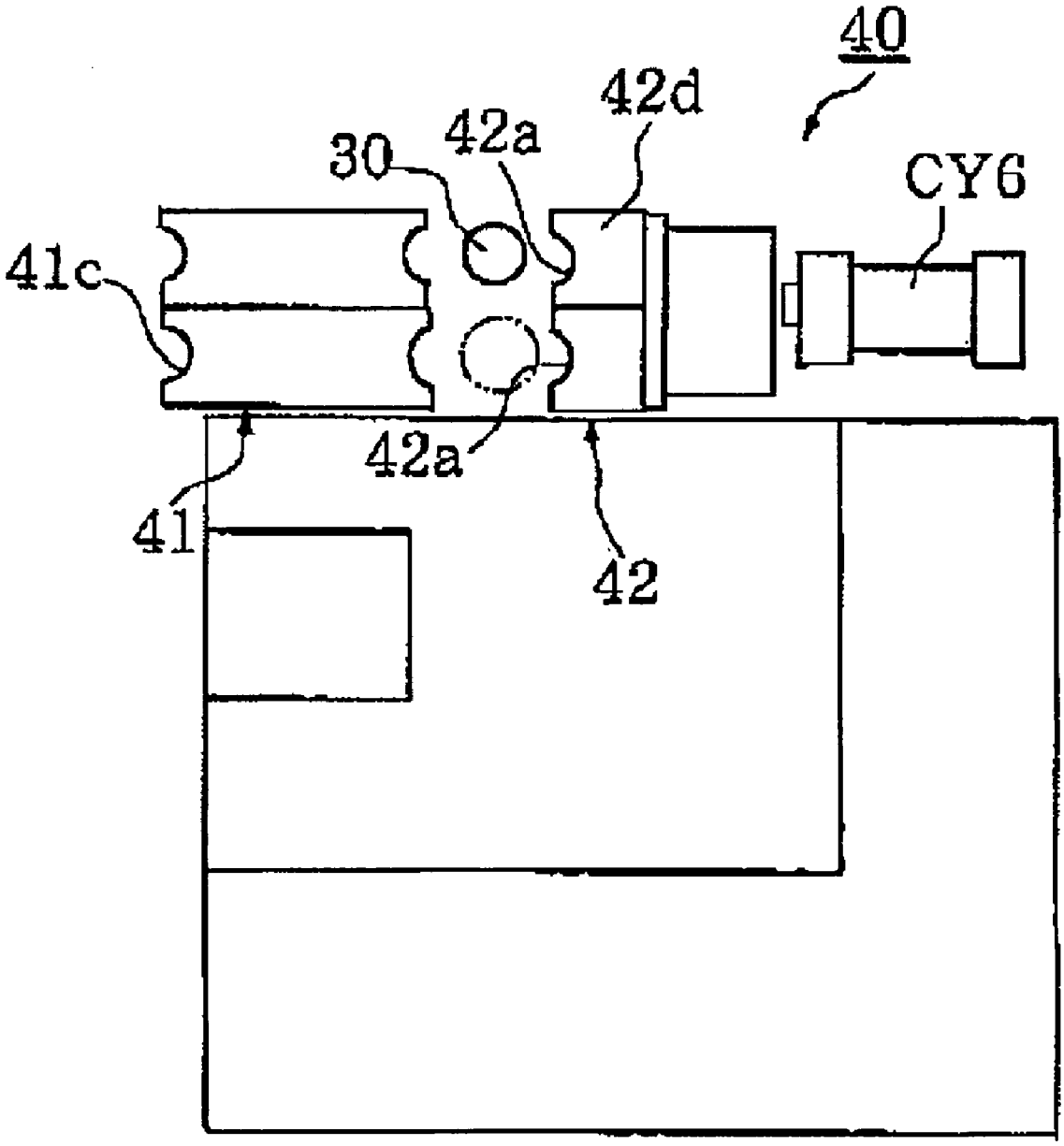
FIG. 8 is a side elevation view of a pressing section of the bending device.

With reference to the drawings, in FIG. 7, a solid line shows a state in which the work piece 30 is going to be clamped by the upper roller while a dashed line shows a state in which the work piece 30 is going to be clamped by the lower roller. The work piece 30 can be moved by the movement of the chucking section 51 in the Z axis direction.

With reference again to FIGS. 15 and 16, in order to remove air accumulating in the plumbing of the pressurizing device 80 (see FIG. 3), the bending device 26 advantageously comprises a coupler 800 that is a similar to the pressurizing coupler 52. The coupler 800 thus is part of an air removal device 801. The air removal device 801 is moved by the air cylinder CY12 in the Y axis direction, and is lowered in the Z axis direction (downward) to be coupled with the pressure receiving coupler 70. Then, the air removal device 801 removes the air accumulating in the plumbing of the pressurizing device 80.

The work piece 30, which has both the ends tightly closed by the end caps 31, 32, is filled with water by the sealing machine 25. In the bending process, the internal pressure of the work piece 30 can be adjusted by the pressurizing device 80.

Figure 21:
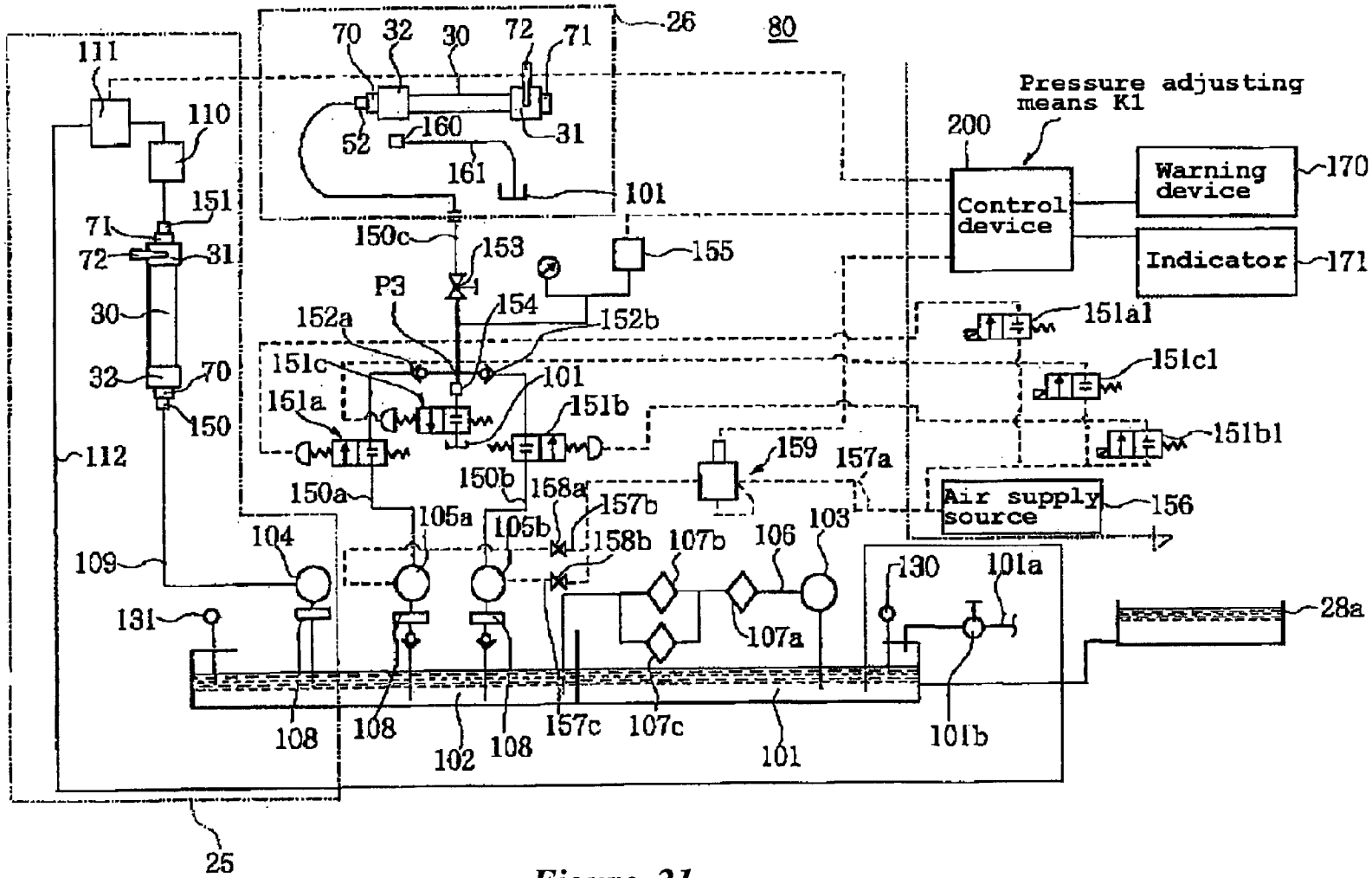
FIG. 21 is an illustration of a pressurizing device of the bending device.

Next, with reference to FIG. 21, the pressuring device 80 can be used to supply water pressure to the bending device 26 and to the sealing machine 25. In the illustrated configuration, the pressurizing device 80 comprises first and second water tanks 101, 102 for collecting water, a circulatory pump 103 for sending the water in the first water tank 101 to the second water tank 102, a water supply pump 104 for pressurizing the water to the work piece 30, high pressure pumps 105*a*, 105*b* for pressurizing the water in the work piece 30 during the bending process and so forth.

The first and second water tanks 101, 102 communicate with each other through a communicating conduit 106. The circulatory pump 103 sends the water in the first water tank 101 to the second water tank 102 through filters 107*a*, 107*b*, 107*c*. The water returned from a work piece 30 following bending is sent to a receiving tank 28*a* in the cap-removing machine 28. The water in the receiving tank 28*a* returns to the first water tank 101 via gravity in the illustrated embodiment, but can be pumped or otherwise conveyed if desired.

The first water tank 101 also can be supplied with water from a water introducing conduit 101*a* of a municipal facility or the like. A downstream end of the municipal water introducing conduit 101*a* is connected to a main water supply valve 101*b* that has an electromagnetic valve controlled by the control device 200 or any other suitable valving configuration. In order to detect respective water levels of the first water tank 101 and the second water tank 102, water level sensors 130, 131 are provided. If the water level falls by evaporation of the water, and the water level detected by the water level sensor 130 decreases lower than the predetermined minimum water level, the control device 200 opens the main water supply valve 101*b* to provide supplemental water. If the water level detected by the water level sensor 130 reaches a predetermined maximum water level, the control device 200 closes the main water supply valve 101*b* to stop supplementing the water supply.

Also, when the water level detected by the water level sensor 130 decreases lower than the predetermined minimum water level, the control device 200 drives the circulatory pump 103 to send the water in the first water tank 101 to the second water tank 102. When the water level detected by the water level sensor 130 reaches a predetermined maximum water level, the control device 200 stops the circulatory pump 103.

The water supply pump 104 and the high pressure pumps 105*a*, 105*b* are arranged to draw the water in the second water tank 102 through respective bubble detecting sensors 108. Each bubble detecting sensor 108 detects bubbles entrained within the water drawn by the supply pump 104 or the high pressure pumps 105, 105*b* and sends data regarding the bubble content to the control device 200. If any one of the bubble detecting sensors 108 detects the presence of enough bubbles in the water supply, the control device 200 determines that there is a problem with the water supply and the control device 200 stops the water supply pump 104 and the high pressure pumps 105*a*, 105*b*.

Preferably, the water supply pump 104 is driven after both of the ends of the work piece 30 are tightly closed by the end caps 31, 32. An outlet port of the water supply pump 104 is connected to a water supply coupler 150 through a water supply conduit 109, and the pump 104 supplies water to the work piece 30 if the water supply coupler 150 is connected to the pressure receiving coupler 70 of the end cap 32. Thus, the internal cavity of the work piece 30 can be filled with liquid in the sealing machine 25. It should be noted that the use of water is only a preferred configuration and other fluids can be substituted for water. Accordingly, as used herein, water should be broadly construed to mean fluid unless otherwise apparent from its usage.

A water discharge/air removal coupler 151 connected to the coupler 71 of the end cap 31 is connected to a first water drain 112 including a bubble detecting sensor 110 and a flow sensor 111. A downstream end of the first water drain 112 returns the water to the first water tank 101. The bubble detecting sensor 110 determines whether air removal has been completed or not. The sensor 110 can detect bubbles contained in the water that flows through the first water drain 112 and send corresponding data to the control device 200. The flow sensor 111 detects an amount of the water that flows through the first water drain 112 and sends corresponding data to the control device 200. The flow sensor 111 can be used to detect the flow rate, the flow volume or both. If the flow sensor 111 detects a flow of water while the bubble detecting sensor 110 detects no bubbles, the water supply pump 104 is stopped. Also, an opening and closing valve driving device 950 is driven under the control of the control device 200 to close the opening and closing valve 72.

The high pressure pumps 105*a*, 105*b* are driven to bend the middle portions of the work piece 30 under the condition that both of the ends of the work piece 30 are tightly closed by the respective caps 31, 32 and the internal cavity of the work piece 30 is filled with the liquid. The respective high pressure pumps 105*a*, 105*b* are arranged parallel to each other providing for the maintenance or inspection thereof, and three ways of operation, i.e., operation of either one of them or both of them, are practicable. Thereby, even though either one of the high pressure pump 105*a* and the high pressure pump 105*b* is under the maintenance or inspection, bending can be conducted using the other one.

An outlet port of each high pressure pump 105*a*, 105*b* is connected to the pressurizing coupler 52 of the bending machine 26 through either one of pressurizing conduits 150*a*, 150*b* and a pressurizing conduit 150*c*. The pressurizing coupler 52 supplies the pressurized water to the work piece 30 through the pressure receiving coupler 70 for bending. A predetermined number of bends can be made before an air removal coupler 160 of the air removal device is coupled with the pressurizing coupler 52 to remove air from the pressurizing conduit 150*c*. The air removal coupler 160 is connected to a second water drain 161. An end of the second drain 161 opens at a location in the water tank 101. Thereby, the air existing in the pressurizing path from either one of the high pressure pumps 105*a*, 105*b* to the pressurizing conduit 150*c* can be discharged with the water.

Each pressurizing conduit 150*a*, 150*b* has a two-way valve 151*a*, 151*b* and a check valve 152*a*, 152*b*. A portion of the pressurizing conduit 150*c* between a connecting point P3 of the pressurizing conduits 150*a*, 150*b* and the bending device 26 has a stop valve 153, while another portion of the pressurizing conduit 150*c* between the connecting point P3 and the first water tank 101 has a throttle valve 154 and a two-way valve 151*c*. The two-way valves 151*a*, 151*c* are connected so that the water discharged from the high pressure pump 105*a* can be changed to either one of the pressurizing coupler 52 and the first water tank 101. The connection is made so that the water discharged from the high pressure pump 105*a* can be supplied to either one of the pressurizing coupler 52 and the first water tank 101 by the two-way valve 151*a* and the two-way valve 151*c*. The connection is also made so that the water discharged from the high pressure pump 105*b* can be supplied to either one of the pressurizing coupler 52 and the first water tank 101 by the two-way valve 151*b* and the two-way valve 151*c*. In one configuration, the two-way valve 151*a* is switched by a switch valve 151*a*1, the two-way valve 151*b* is switched by a switch valve 151*b*, and the two-way valve 151*c* is switched by a switch valve 151*c*1.

That is, first and second states can be selected. In the first state, the two-way valve 151*a* or the two-way valve 151*b* is opened and the two-way valve 151*c* is closed so that the high pressure pump 105*a* or the high pressure pump 105*b* and the pressurizing coupler 52 are connected with each other. In the second state, the two-way valve 151*c* is opened so that the high pressure pump 105*a* or the high pressure pump 105*b*, the first water tank 101 and the pressurizing coupler 52 are connected with each other for decreasing the pressure.

A pressure sensor 155 is connected to the pressurizing conduit 150*c* to detect a water pressure in the pressuring conduit 150*c* and to send corresponding data to the control device 200. In this embodiment, plunger pumps are used as the high pressure pumps 105*a*, 105*b*. An air passage from an air supply source 156 is bifurcated to air supply conduits 157*b*, 157*c* downstream of an air supply conduit 157*a* to supply air to the high pressure pumps 105*a*, 105*b*. Each air supply conduit 157*b*, 157*c* has a switch valve 158*a*, 158*b*. The switch valves 158*a*, 158*b* are used to activate one of the respective high pressure pumps 105*a*, 105*b*.

A discharge pressure adjusting device 159 changes a pressure of driving air so that a discharge pressure of each high pressure pump 105*a*, 105*b* increases or decreases. The discharge pressure adjusting device 159 changes the pressure of the driving air in response to command value sent from the control device 200. The control device 200 determines the command value in such a manner that the water pressure detected by the pressure sensor 155 is consistent with a predetermined target water pressure. That is, each high pressure pump 105*a*, 105*b* is feedback-controlled so that the discharge pressure of the high pressure pump 105*a*, 105*b* is substantially consistent with the target water pressure.

The target water pressure can correspond to a particular configuration of the exhaust pipe 8. For example, the target water pressure can correspond to a curvature of each bent portion. That is, a bent portion having a larger curvature (a radius of curvature is smaller) is bent under a higher water pressure than is given to a bent portion having a smaller curvature. During the bending process, for example, the control device preferably controls the water pressure to a generally fixed level, or controls it to be higher while a bent angle of the bent portion becomes larger.

In some configurations, a bent angle sensor can be provided to determine the water pressure in connection with the bent angle. For example, a water pressure can increase from the starting of bending within the water pressure increase corresponding to the bent angle. Also, in accordance with the increase of the bent angle made while the bending process proceeds, the water pressure can gradually increase from the water pressure at the initiation of the bending process to the maximum water pressure that is given when the bent angle becomes, for example, 70–80% of the target angle. Afterwards, while the bending process further proceeds, the water pressure can gradually decrease from the maximum water pressure. Thereby, a bent pipe that has less distortion in its cross section can be obtained because the pipe can be bent along its central line.

The bending device 26 in this embodiment has pressure adjusting mechanism K1 that adjusts the internal pressure of the work piece 30 to each bend of the respective middle portions. In the illustrated configuration, the pressure adjusting mechanism K1 comprises the pressure sensor 155, the control device 200 and the discharge pressure adjusting device 159.

The pressure adjusting mechanism K1 adjusts the internal pressure of the work piece 30 in such a manner that one pressure suitable for one bending is changed to another pressure suitable for a next bending after the first bending operation ends and before the next bending operation begins. Because of the pressure adjustment, a water pressure in the work piece preferably is not decreased which improves productivity by maintaining at least a predetermined water pressure in the work piece.

The work piece 30 is clamped by the clamping section 42 and is pushed by the pressing section 43 during the bending process of this work piece, and the internal pressure is previously adjusted before the clamping and the pressing in such a manner that each pressure becomes the pressure that is suitable for the respective bending that is made after the clamping and the pressing or becomes a certain pressure which is lower than the pressure. Because of the previous adjustment of the pressure, the internal pressure of the work piece 30 is sufficiently high before the clamping and the pressing. Thus, the work piece 30 is not likely to be damaged by the clamping and the pressing of the work piece 30. Additionally, when multiple portions are bent, the pressure is preferably adjusted before each subsequent clamping and pressing action.

The clamping of the work piece 30 is released after the final bending process of the work piece 30 ends, and after the work piece is released, the internal pressure can be reduced to zero or substantially zero. Thus, while clamped, the work piece is under pressure, which pressure preferably is not removed until after the work piece is unclamped. Thus, the work piece 30 is less likely damaged by the clamping of the work piece 30. For this reason, as well, the pressing section 43 preferably is retracted before the internal pressure of the work piece 30 becomes zero or the amount adjacent to zero.

When the bending process described above is used for each bend in a work piece featuring multiple bends, releasing the clamping of the work piece after one bend and, before clamping the work piece for the next bend, adjusting the internal pressure during transit of the work piece results in improved productivity. Further, in one configuration, the internal pressure of the work piece is reduced during the transit, which is easier to do than increasing the internal pressure. Thus, the pressure is adjusted to a level that is suitable for the next subsequent bending operation.

A test pressure that is lower than the pressure suitable for each bending of the work piece 30 is given before the first bending of the work piece 30 starts, and unless the internal pressure of the work piece 30 increases to the test pressure within a preset time when the test pressure is applied, the system detects an abnormality and the identification of such an abnormality results in operation of a warning device 170. In one configuration, an indicator 171 indicates specific abnormal conditions and the high pressure pumps 105*a*, 105*b* are stopped. Through the use of such an abnormality detection system, the number of inferior goods produced by the system can be reduced.

Figure 22:
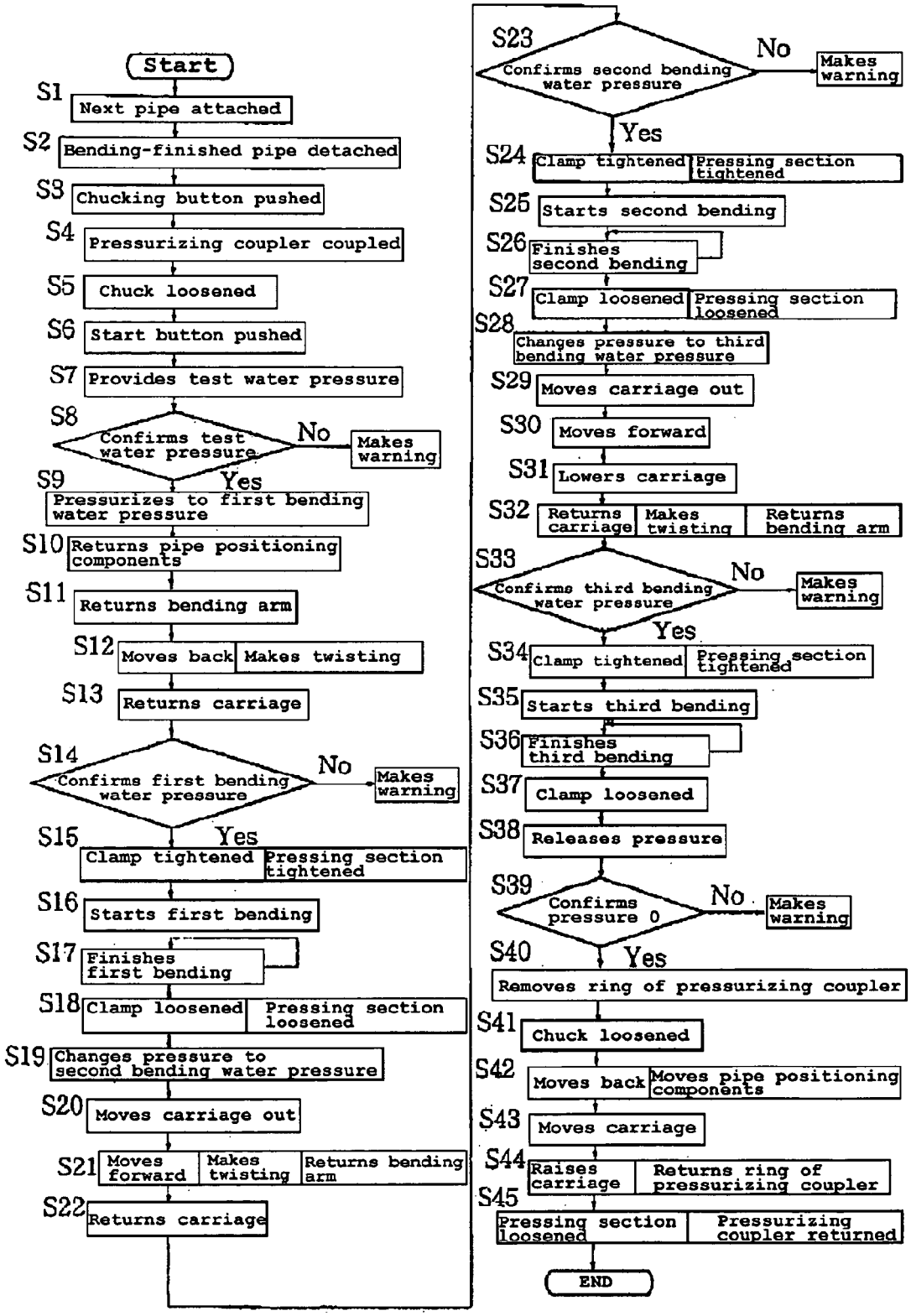
FIG. 22 is a flowchart for describing a bending operation that is arranged and configured in accordance with certain features, aspects and advantages of the present invention.
Figure 24:
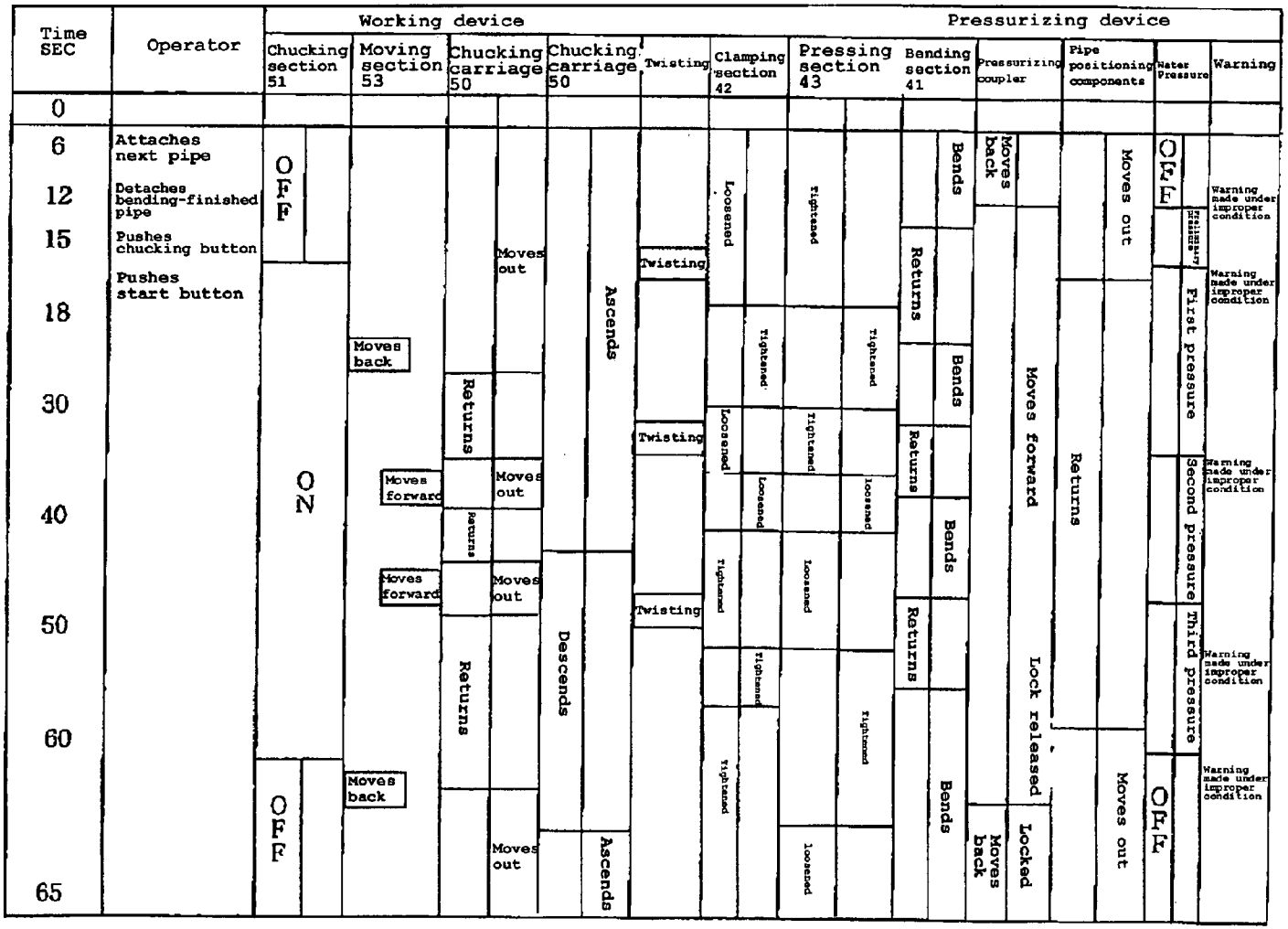
FIG. 24 is a time chart for describing the bending operation.

With reference now to FIGS. 22–24, a method of using the disclosed system will be described. Initially, in the illustrated bending machine 26, the chucking section 51 is under an OFF condition, the clamping section 42 is loosened, the pressing section 43 is loosened, and the pressurizing coupler 52 is at the retreat position to keep the water pressure under an OFF condition.

Under those conditions, the operator attaches a raw work piece 30 (S1), the operator detaches a completed work piece 30 (S2), and the operator pushes the chucking button SW11 (S3). The pressurizing coupler 52 thus moves forward to be coupled with the pressure receiving coupler 70 (S4), and the chuck of the chucking section 51 is tightened (S5).

Next, the operator pushes the start button SW10 to start the bending operation. Under this condition, the high pressure pump 105*a*, 105*b* operates in the water pressure section of the pressurizing device 80 to give a preparatory pressure to the work piece 30, i.e., to provide a test water pressure (S7). The test water pressure is monitored for reductions in the pressure. If this pressure falls below a preset pressure, the control device 200 determines that it is abnormal, and makes a warning (S8).

If the test pressure is sufficiently constant, the control device 200 increases the internal pressure to a first bending water pressure (S9). The receiving rack arm 320 is returned to the waiting position (S10), and the clamping table 44 is returned to its initial position at which it is located before the bending (S11). The chucking carriage 50 is moved to the bending position in the Y axis direction (rearward), the chucking section 51 makes the twisting operation (S12), and the chucking table 50*a* is moved to the bending position P2 from the setting position P1 (S13).

After the pressurization of the step S9 starts and before or after the step S13 completes, the water pressure is checked whether it is within an allowable range of the first bending water pressure. If the water pressure is out of the allowable range, an alarm is activated (S14). If the water pressure is in the allowable range, the clamping section 42 is tightened, and the pressing section 43 is tightened (S15). The first bending starts (S16). When the first bending is completed (S17), the clamping section 42 is loosened, and the pressing section 43 is loosened (S18). The pressure is changed to a second bending water pressure (S19). The chucking table 50*a* moves to the P1 position in the X axis direction (S20). The chucking carriage 50 is moved forward in the Y axis direction, the chucking table 50*a* makes the twist, and, simultaneously, the clamping table 44 is returned to its initial position (S21). The chucking table 50*a* is moved to the P2 position in the X axis direction (S22).

After the water pressure change S19 starts and before or after the step S22 completes, the water pressure is checked whether it is within an allowable range of the second bending water pressure. If the water pressure is out of the allowable range, the alarm is activated (S23). If the water pressure is in the allowable range, the clamping section 42 is tightened, and the pressing section 43 is tightened (S24). The second bending starts (S25). When the second bending is completed (S26), the clamping section 42 is loosened, and the pressing section 43 is loosened (S27). The pressure is changed to a third bending water pressure (S28). The chucking table 50*a* moves to the P1 position in the X axis direction (S29). The chucking carriage 50 is moved forward in the Y axis direction (S30). The chucking table 50*a* is lowered in the Z axis direction so as to set the central axis of the chucking section 51 at the level of the clamp receiver 41*a* positioned below the roll die 41*b* (S31). The chucking table 50*a* is twisted, and, simultaneously, the chucking table 50*a* is moved to the P2 position in the X axis direction (S32).

After the change of the pressure of the step S28 starts and before or after the step S32 completes, the water pressure is checked whether it is within an allowable range of the third bending water pressure. If the water pressure is out of the allowable range, the warning is made (S33). If the water pressure is in the allowable range, the clamping section 42 is tightened, and the pressing section 43 is tightened (S34). The third bending starts (S35). When the third bending is completed (S36), the clamping section 42 is loosened (S37). The internal water pressure of the bending completed work is released (S38). The water pressure is checked by the pressure sensor 155 whether it is zero (gauge pressure). If it is not zero, the warning is made (S39).

When the water pressure zero is confirmed, the ball pressing ring 70*d* of the pressurizing coupler 52 is removed (S40). The chucking of the chucking section 51 is loosened (S41). The chucking carriage 50 is moved back in the Y axis direction, and the receiving rack arm 320 is rotated to the setting position from the waiting position (S42). The chucking section 51 is moved to the P1 position in the X axis direction (S43). The chucking section 51 is raised in the Z axis direction so as to set the central axis of the chucking section 51 at the level of the clamp receiver 41*a* positioned below the roll die 41*b*, and the ball pressing ring 70*d* of the pressurizing coupler 52 is returned (S44). The pressing section 43 is loosened, and the pressurizing coupler 52 is moved back relative to the chucking section 51 (Y axis direction) to prepare for the bending of the next work piece 30 (S45).

Additionally, if respective steps in the following groups (1)–(4) are simultaneously conducted, the time for the bending can be shortened: (1) the steps S9 through S13; (2) the steps S19 through S21 or the steps S19, S21 and S22; (3) the steps S29 through S31 or the steps S29 and S30 through S32; and (4) the steps S40 through S45.

Further, the bending machine 40 side is fixed in the respective X, Y and Z axis directions relative to the platform 500, the chucking section 51 side is movable in the respective X, Y and Z axis directions relative to the platform 500 via the chucking carriage 50 and the chucking table 50*a*. Alternatively, however, the chucking section 51 side can be fixed to the platform 500, and also the bending machine 40 side is movable in the respective X, Y and Z axis directions relative to the platform 500. That is, a bending machine support is interposed between the platform 500 and the bending machine 40, and the bending machine support is movable in the respective X, Y and Z axis directions relative to the platform 500. Also, a pressing section support is fixed to the bending machine support, and the bending section 41 and the clamping section support 502 are rotatable about the Z axis.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. A method of making multiple bends to a work piece, wherein the work piece is generally tubular in configuration, the work piece comprising a first end and a second end, a first end cap substantially closing the first end and a second end cap substantially closing the second end, an internal cavity being defined within the work piece between the first end cap and the second end cap, the method comprising:

introducing a fluid into said internal cavity through one of said first and second end caps;

pressurizing the fluid to a first pressure within said internal cavity;

conducting a first bending operation;

after conducting the first bending operation but before conducting a second bending operation, adjusting the fluid to a second pressure within said internal cavity, said second pressure corresponding to a desired pressure for conducting the second bending operation; and after conducting the second bending operation but before conducting a third bending operation, adjusting the fluid to a third pressure within said internal cavity, said third pressure corresponding to a desired pressure for conducting the third bending operation.

2. The method of claim 1, wherein the fluid is pressurized to achieve a test pressure that is lower than the first pressure before the first bending operation begins and, if the test pressure is not attained within a predetermined period, alerting an operator to an abnormal work piece.

3. The method of claim 1, wherein the second bending operation comprises clamping the work piece after the fluid is adjusted to the second pressure or a pressure lower than the second pressure.

4. The method of claim 3, wherein the fluid is pressurized to achieve a test pressure that is lower than the first pressure before the first bending operation begins and, if the test pressure is not attained within a predetermined period, alerting an operator to an abnormal work piece.

5. The method of claim 3, wherein the third bending operation comprises releasing the work piece before the fluid is adjusted to a substantially zero pressure.

6. The method of claim 5, wherein the fluid is pressurized to achieve a test pressure that is lower than the first pressure before the first bending operation begins and, if the test pressure is not attained within a predetermined period, alerting an operator to an abnormal work piece.

7. The method of claim 1, wherein the third bending operation comprises releasing the work piece before the fluid is adjusted to a substantially zero pressure.

8. The method of claim 7, wherein the fluid is adjusted toward the second pressure once the work piece is released and the work piece is adjusted for the second bending operation while the fluid is adjusted toward the second pressure.

9. The method of claim 8, wherein the fluid is pressurized to achieve a test pressure that is lower than the first pressure before the first bending operation begins and, if the test pressure is not attained within a predetermined period, alerting an operator to an abnormal work piece.

10. A method for bending a work piece, wherein a middle portion of a work piece is bent by a bending machine mounted on a platform when a first end of the work piece, which has an internal cavity filled with a pressurized liquid and defined, in part, by a first end cap and a second end cap, is cantilevered by a chucking section, the method comprising connecting a coupler to the first end cap, the first pressurizing coupler thereby being fluidly connected to the internal cavity such that an internal pressure of the work piece can be adjusted through the coupler, moving the bending machine relative to the chucking section to move the work piece from a setting position to a bending position at which the work piece can be bent by the bending section; adjusting the internal pressure during bending and, following the bending of the work piece, releasing the cantilevering support by the chucking section, detaching the pressurizing coupler, and moving the chucking section to the setting position relative to the bending machine.

11. The method of claim 10 further comprising decreasing the internal pressure of the work piece before the chucking section moves to the setting position from the bending position relative to the bending machine, and releasing the cantilevering support by the chucking section after the chucking section moves.

12. The method of claim 11, wherein the coupler is movable toward or away from the chucking section and the coupler is attachable to and detachable from the first end cap, and wherein the method further comprises coupling the internal cavity of the work piece and a pressurizing device with each other by advancing the coupler relative to the chucking section while the chucking section moves from the setting position to the bending position relative to the bending machine to start increasing the internal pressure of the work piece while the chucking section moves from the setting position to the bending position relative to the bending machine or to start decreasing the internal pressure before or while the chucking section moves from the bending position to the setting position relative to the bending machine.

13. The method of claim 12 further comprising, after decreasing the internal pressure and while the chucking section moves from the bending position to the setting position, either separating the coupler from the chucking section or detaching the first end cap from the coupler.

14. A device for bending a work piece, wherein the work piece is generally tubular in configuration, the work piece comprising a first end and a second end, a first end cap substantially closing the first end and a second end cap substantially closing the second end, an internal cavity being defined within the work piece between the first end cap and the second end cap, the device comprising:

a bending device and a chucking carriage, the chucking carriage being moveable relative to the bending device, a pressurizing coupler axially moveable relative to the chucking carriage, the pressurizing coupler being configured to removably connect with the first end cap, the pressurizing coupler comprising a fluid passage that is in communication with the internal cavity of the work piece when the pressurizing coupler is connected with the first end cap; and pressure adjusting means for altering a pressure in the internal cavity of the work piece to a bend specific pressure prior to a second bending operation and subsequent to a first bending operation.

15. The device of claim 14, wherein the bending device comprises a clamping mechanism, the clamping mechanism comprising a clamp receiver and a clamp pusher, the clamp pusher being movable toward the clamp receiver during a clamping operation, the clamp receiver and the clamp pusher being pivotable about a roll die after the clamping operation to effect bending of the work piece.

16. The device of claim 15, wherein the pressure adjusting means also is configured to alter the pressure in the internal cavity of the work piece before the clamping operation in such a manner that each pressure becomes either a pressure that is suitable for a bending operation that follows the clamping operation or a pressure that is lower than a pressure that is suitable for the bending operation that follows the clamping operation.

17. The device of claim 16, wherein the pressure adjusting means operates after the clamping mechanism releases the work piece following the bending operation.

18. The device of claim 14 further comprising an alert system that is coupled to a controller, the controller being adapted to detect a pressure loss from within the work piece and, if the pressure loss is detected, activate the alert system.

19. The device of claim 18, wherein the detection of the pressure loss comprises determining that a predetermined pressure is not attained within a predetermined period of time.

20. The device of claim 14 further comprising a rack arm, the rack arm comprising a stopper portion, the stopper portion being cooperable with one of the end caps to limit axial elongation of the work piece during bending.

* * * * *